US010444701B2

(12) United States Patent
Takeuchi et al.

(10) Patent No.: US 10,444,701 B2
(45) Date of Patent: Oct. 15, 2019

(54) IMAGE FORMING APPARATUS

(71) Applicant: CANON KABUSHIKI KAISHA, Tokyo (JP)

(72) Inventors: Toshiaki Takeuchi, Susono (JP); Takahito Ueno, Mishima (JP); Masaki Seto, Gotemba (JP); Bunro Noguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 57 days.

(21) Appl. No.: 15/893,495

(22) Filed: Feb. 9, 2018

(65) Prior Publication Data

US 2018/0231933 A1 Aug. 16, 2018

(30) Foreign Application Priority Data

Feb. 14, 2017 (JP) ..... 2017-025412
Apr. 10, 2017 (JP) ..... 2017-077613

(51) Int. Cl.
*G03G 21/18* (2006.01)
*G03G 15/08* (2006.01)
*G03G 15/00* (2006.01)

(52) U.S. Cl.
CPC ..... *G03G 21/1857* (2013.01); *G03G 15/0872* (2013.01); *G03G 15/0889* (2013.01); *G03G 15/5008* (2013.01); *G03G 21/185* (2013.01); *G03G 21/1864* (2013.01)

(58) Field of Classification Search
CPC ..... G03G 21/1864; G03G 21/1857
See application file for complete search history.

(56) References Cited

U.S. PATENT DOCUMENTS 4,190,349 A * 2/1980 Ohno ..... G03B 27/6235 399/213
2017/0308007 A1* 10/2017 Imaizumi ..... G03G 15/1615

FOREIGN PATENT DOCUMENTS

| | | | |
|---|---|---|---|
| EP | 2259156 | A2 | 12/2010 |
| JP | 2005265951 | A | 9/2005 |
| JP | 2007171677 | A | 7/2007 |
| JP | 2008225009 | A | 9/2008 |
| JP | 2010169875 | A | 8/2010 |
| JP | 2010197717 | A | 9/2010 |

(Continued)

*Primary Examiner* — Sevan A Aydin
(74) *Attorney, Agent, or Firm* — Canon U.S.A., Inc. IP Division

(57) ABSTRACT

Provided are a drive force transmission member and control unit. The drive force transmission member has multiple first engaging portions. Drive force is transmitted from the drive force transmission member to a drive force receiving member with each first engaging portion engaged with a second engaging portion of the drive force receiving member. The second engaging portions are movable in a radial direction centered on a rotation axis line of the drive force transmission member. The control unit performs rotation control of forward rotation of the drive force transmission member by α° and thereafter backward rotation by β° after a cartridge is mounted to an apparatus main body but before image formation. Each of the multiple first engaging portions is upstream in the forward rotation direction of the drive force transmission member from the second engaging portion out of the multiple second engaging portions with which engaging will be realized.

18 Claims, 25 Drawing Sheets

(56) References Cited

FOREIGN PATENT DOCUMENTS

| | | | |
|---|---|---|---|
| JP | 2011075659 | A | 4/2011 |
| JP | 2012013718 | A | 1/2012 |
| WO | 2016/088303 | A1 | 6/2016 |
| WO | 2016137014 | A1 | 9/2016 |

* cited by examiner

IMAGE FORMING APPARATUS

BACKGROUND OF THE INVENTION

Field of the Invention

The present invention relates to a process cartridge or the like used in an image forming apparatus that uses electrophotography.

Description of the Related Art

There is known, in an electrophotographic image forming apparatus, a configuration where components such as a photosensitive drum, developing roller, and so forth, which are rotating members relating to image formation, are integrated into a cartridge that is detachably mountable to an image forming apparatus main body (hereinafter, "apparatus main body"). In such a configuration, many apparatuses employ a configuration where driving force is received from the apparatus main body in order to rotate the photosensitive drum within the cartridge. There is known a configuration regarding this where a drive force transmission member having multiple first engaging portions at the apparatus main body side engages a coupling member serving as a driving force receiving member having multiple second engaging portions at the cartridge side, and transmits drive force.

International Publication No. WO2016/137014A1 discloses a configuration having a drive shaft serving as a driving force transmission member, having recesses as multiple first engaging portions on an outer peripheral face, and a coupling member serving as a driving force receiving member, having multiple second engaging portions that are movable in the radial direction. Driving force is transmitted in this configuration by the second engaging portions each entering and engaging the recesses (first engaging portions).

There is a tolerance range regarding manufacturing error and so forth of driving force transmission member and driving force receiving member. Accordingly, depending on the relative phase relationship between the driving force transmission member and driving force receiving member, a partially-engaged state may occur where only part of the first engaging portions and second engaging portions engage may occur, where part of the first engaging portions are not engaging second engaging portions and part of the second engaging portions are not engaging first engaging portions. If rotated in such a partially-engaged state, the rotational precision of the driving force receiving member will be poor, since force is concentrated just on part of the first engaging portions and part of the second engaging portions, which can lead to defective images when forming images. Further, force being concentrated just on part of the first engaging portions and part of the second engaging portions may result in damage of the driving force transmission member and/or driving force receiving member.

SUMMARY OF THE INVENTION

It has been found desirable to engage the driving force transmission member and driving force receiving member in a sure manner, thereby suppressing deterioration in rotational precision and damage of the driving force transmission member and driving force receiving member.

An image forming apparatus includes an apparatus main body to which a cartridge can be detachably mounted, a drive force transmission member configured to transmit drive force to a drive force receiving member of the cartridge, and a control unit configured to perform a rotation control operation, where rotation of the drive force transmission member is controlled. Image formation is performed on recording material by performing forward rotation of the drive force transmission member and transmitting drive force to the drive force receiving member of the cartridge. The drive force transmission member includes a plurality of first engaging portions. The drive force transmission member is configured to rotate forwards when the drive force receiving member rotates forward in a state where the plurality of first engaging portions each engage with a plurality of second engaging portions that the drive force receiving member has, and image formation on the recording material can be performed while the drive force receiving member is being rotated forwards. Of the plurality of first engaging portions and the plurality of second engaging portions, one plurality of engaging portions each at least move in a radial direction centered on a rotation axis line of the drive force transmission member, and can move between an engageable position where the other plurality of engaging portions can be engaged, and a non-engageable position where the other plurality of engaging portions cannot be engaged. The control unit is configured to execute, after the cartridge has been mounted to the apparatus main body but before image formation is performed on the recording material, (i) a forward rotation step where the drive force transmission member is rotated forward by $\alpha°$ and the drive force receiving member is rotated forward, and (ii) a backward rotation step where the drive force transmission member is rotated backward by $\beta°$, after the forward rotation step. Each of the plurality of first engaging portions is in a state disposed upstream in the forward rotation direction of the drive force transmission member from the second engaging portion out of the plurality of second engaging portions with which engaging will be realized in the end, due to the control unit having executed the forward rotation step and the backward rotation step.

Further features of the present invention will become apparent from the following description of exemplary embodiments with reference to the attached drawings.

DESCRIPTION OF THE EMBODIMENTS

Image forming apparatuses and a process cartridge according to embodiments will be described below with reference to the drawings. Note that an image forming apparatus is an arrangement that forms images on a recording medium using an electrophotographic image forming processing, for example. Examples include electrophotographic copiers, electrophotographic printers (e.g., light-emitting diode (LED) printers, laser beam printers, etc.), electrophotographic facsimile apparatuses, and so forth. The term "cartridge" refers to an arrangement that is detachably mountable to an image forming apparatus main body 100A. Of various types of cartridges, a cartridge where a photosensitive member and process arrangement that act upon the photosensitive member will be referred to as "process cartridge" in particular. An integrated arrangement of a photosensitive drum and a coupling member and so forth will be referred to as a "drum unit".

A full-color image forming apparatus that has four process cartridges detachably mounted is exemplarily described in the following embodiments. Note however, that the number of process cartridges to be mounted to the image forming apparatus is not restricted to this number. It should also be noted that materials, layouts, dimensions, other numerical values, and so forth, regarding the configuration disclosed in the embodiments are not restrictive, unless specifically stated as being restrictive. Also, the terms "up", "upper, and "upwards" refer to the upwards direction in the gravitational direction when the image forming apparatus is installed, unless specifically stated otherwise.

First Embodiment

Overview of Electrophotographic Image Forming Apparatus

Figure 1:
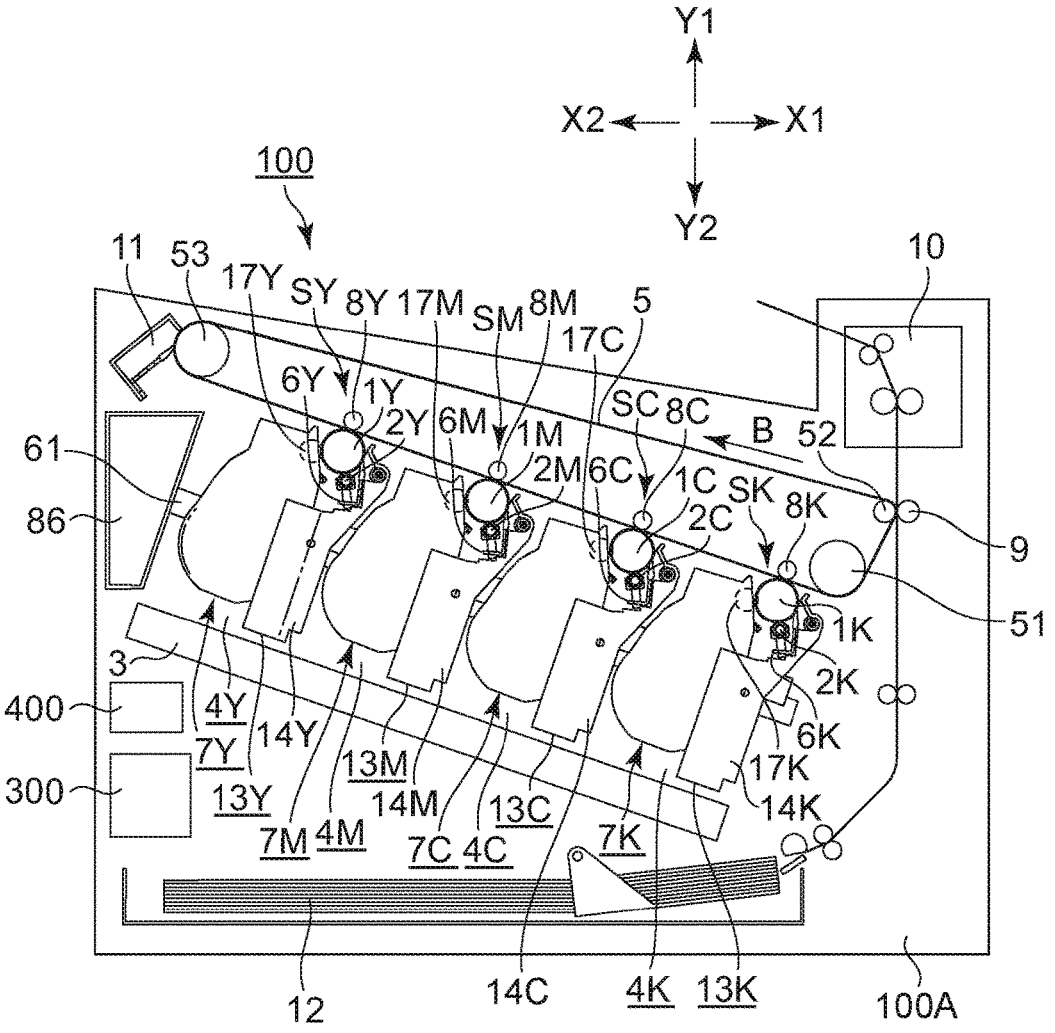
FIG. 1 is a schematic cross-sectional view of an image forming apparatus.

First, the overall configuration of an electrophotographic image forming apparatus (image forming apparatus) according to the present embodiment will be described with reference to FIG. 1. FIG. 1 is a schematic cross-sectional view of the image forming apparatus 100 according to the present embodiment. The image forming apparatus 100 has multiple image forming portions, which serve as first, second, third, and fourth image forming portions SY, SM, SC, and SK for forming images of the colors yellow (Y), magenta (M), cyan (C), and black (K), respectively, as illustrated in FIG. 1. The first through fourth image forming portions SY, SM, SC, and SK in the present embodiment are arrayed in a single line, generally in the horizontal direction.

Note that in the present embodiment, the configurations and operations of the process cartridges 7 (7Y, 7M, 7C, and 7K) are substantially the same, except for the colors of formed images being different. Accordingly, in cases in the following description where there is no particular need to distinguish therebetween, the Y, M, C, and K will be omitted, a description will be made collectively.

In the present embodiment, the image forming apparatus 100 has four cylinders having photosensitive layers (photosensitive drum) 1, serving as multiple image bearing members, that are arrayed in a direction slightly inclined toward the vertical direction. A scanner unit (exposing device) 3 is provided at the lower side of the process cartridge 7 in the gravitational direction. Provided in the vicinity of the photosensitive drum 1 is a charging roller 2 and so forth, serving as a process arrangement (process device, process member) that acts upon the photosensitive layers.

The charging roller 2 is a charging arrangement (charging device, charging member) that uniformly charges the surface of the photosensitive drum 1. The scanner unit (exposing device) 3 is an exposing arrangement (exposing device, exposing member) that forms an electrostatic image (electrostatic latent image) on the photosensitive drum 1 by irradiation by laser, based on image information. Provided in the vicinity of the photosensitive drum 1 is a developing device (developing unit) 4 and a cleaning blade 6 serving as a cleaning arrangement (cleaning device, cleaning member).

Further, an intermediate transfer belt 5 serving as an intermediate transfer member to transfer a toner image on the photosensitive drum 1 onto a recording material (sheet, recording medium) 12 is disposed facing the four photosensitive drums 1. The developing unit 4 according to the present embodiment uses a nonmagnetic one-component developing agent (hereinafter, "toner") as a developing agent, and employs contact developing, where a developing roller 17 serving as a developing agent bearing member is brought into contact with the photosensitive drum 1.

In the above-described configuration, a toner image formed on the photosensitive drum 1 is transferred onto a sheet (paper) 12, and the toner image transferred into the sheet is fixed. The process cartridge includes the charging roller 2 that charges the photosensitive drum 1, and the cleaning blade 6 that cleans untransferred residual toner off of the photosensitive drum 1, as process arrangements that act upon the photosensitive drum 1. The transfer residual toner remaining on the photosensitive drum 1 without being transferred into the sheet 12 is recovered by the cleaning blade 6. The transfer residual toner recovered by the cleaning blade 6 is stored in a removed developing agent storage unit (hereinafter, "waste toner storage unit") 14*a* via an opening 14*b*. The waste toner storage unit 14*a* and cleaning blade 6 are integrated, and make up a cleaning unit (photosensitive unit, drum unit, image bearing unit) 13.

The developing unit 4 and the cleaning unit 13 are integrated to form a unit (form a cartridge), thereby making up the process cartridge 7. The image forming apparatus 100 has guides (positioning arrangements) such as mounting guides, positioning members (omitted from illustration), and so forth, provided to a body frame. The configuration is such that the process cartridge 7 is guided by the aforementioned guides, and detachably mounted to the image forming apparatus main body 100A. The toners of the colors yellow (Y), magenta (M), cyan (C), and black (K), are stored in the process cartridges 7 of the respective colors.

The intermediate transfer belt 5 rotates (moves) in the direction of the arrow B in FIG. 1, in contact with the photosensitive drums 1 that the process cartridges 7 have. The intermediate transfer belt 5 runs around multiple supporting members (driving roller 51, secondary-transfer opposing roller 52, slave roller 53). Four primary transfer rollers 8 serving as a primary transfer arrangement are arrayed on the inner peripheral face side of the intermediate transfer belt 5, facing the photosensitive drums 1. A secondary transfer roller 9 serving as a secondary transfer arrangement is disposed at a position facing the secondary-transfer opposing roller 52 at the outer peripheral face side of the intermediate transfer belt 5.

When forming images, the surface of the photosensitive drum 1 is uniformly charged by the charging roller 2 first. Scanning exposure of the surface of the charged photosensitive drum 1 is then performed by laser beams corresponding to image information, emitted from the scanner unit 3. Accordingly, an electrostatic latent image corresponding to the image information is formed on the photosensitive drum 1. The electrostatic latent image formed on the photosensitive drum 1 is developed as a toner image by the developing unit 4. The photosensitive drum is a rotating member (image bearing member) that rotates in a state of bearing an image (developing agent image, toner image) formed on the surface thereof by developing agent (toner).

The toner image formed on the photosensitive drum 1 is transferred (primary transfer) onto the intermediate transfer belt 5 by operation of the primary transfer roller 8. For example, when forming a full-color image, the above-described process is sequentially performed at the four process cartridges 7 (7Y, 7M, 7C, 7K). The toner images of the respective colors, which have been formed on the photosensitive drums 1 of the process cartridges 7, are sequentially subjected to primary transfer onto the intermediate transfer belt 5, so as to be overlaid. Thereafter, the recording material 12 is transferred to a secondary transfer portion in synch with the movement of the intermediate transfer belt 5. The four-color toner image on the intermediate transfer belt 5 is then transferred together onto the recording material 12 conveyed to the secondary transfer portion formed by the intermediate transfer belt 5 and secondary transfer roller 9.

The recording material 12 onto which the toner image has been transferred is conveyed to a fixing device 10 that serves as a fixing arrangement. The recording material 12 is subjected to heat and pressure at the fixing device 10, thereby fixing the toner image onto the recording material 12. Primary-transfer residual toner remaining on the photosensitive drum 1 after the primary transfer process is removed by the cleaning blade 6 and collected as waste toner. The secondary-transfer residual toner remaining on the intermediate transfer belt 5 after the secondary transfer process is removed by an intermediate transfer belt cleaning device 11. Note that the image forming apparatus 100 is also arranged to be able to form monochrome or multi-color images using a desired one or some (not all) image forming portions.

Overall Configuration of Process Cartridge

Next, an overview of the process cartridge 7 (cartridge 7) mounted to the image forming apparatus main body 100A according to the present embodiment will be described with reference to FIGS. 2 through 4. A cartridge 7*a* storing yellow color toner, a cartridge 7*b* storing magenta color toner, a cartridge 7*c* storing cyan color toner, and a cartridge 7*d* storing black color toner, are all of the same configuration. Accordingly, the cartridges 7*a*, 7*b*, 7*c*, and 7*d* will be described as "cartridge 7" in the following description, with the term "cartridge 7" collectively referring to the cartridges 7*a*, 7*b*, 7*c*, and 7*d*. Other components of the cartridges will also be referred to collectively in the same way.

Figure 2:
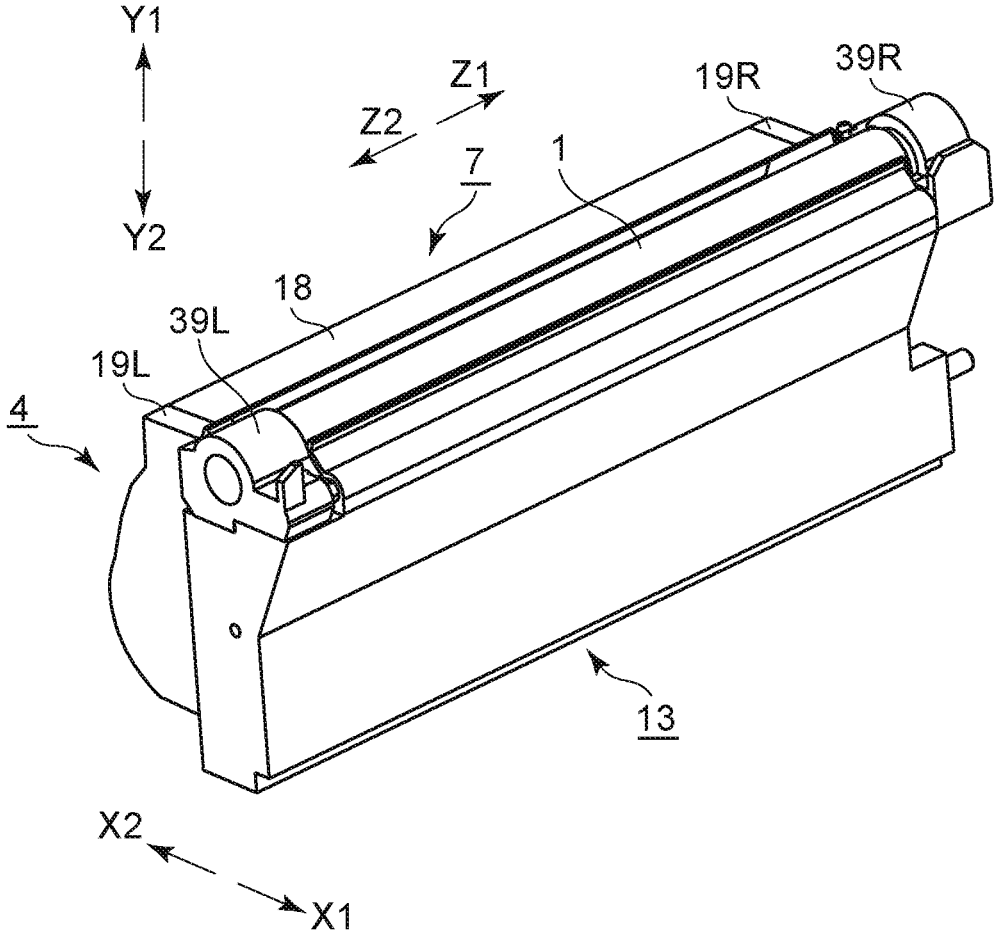
FIG. 2 is an external perspective view of a process cartridge.

FIG. 2 is an external perspective view of the process cartridge 7. As illustrated in FIG. 2, the rotation axis direction of the photosensitive drum 1 is the Z direction (arrows Z1 and Z2), a horizontal direction in FIG. 1 is the X direction (arrows X1 and X2), and a vertical direction in FIG. 1 is the Y direction (arrows Y1 and Y2).

Figure 3:
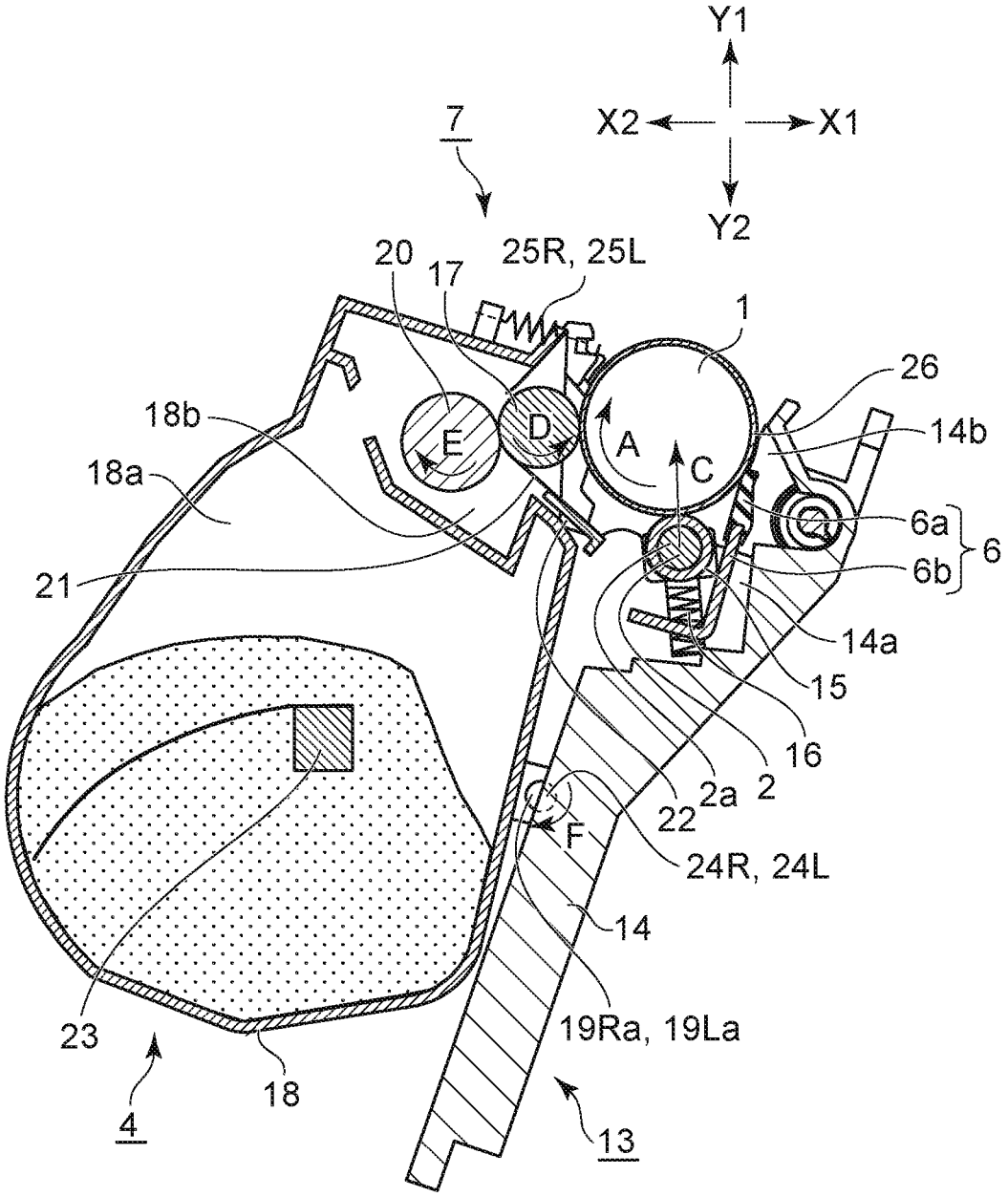
FIG. 3 is a cross-sectional view of the process cartridge, taken along a direction perpendicular to a rotation axis of a photosensitive drum.

FIG. 3 is a schematic cross-sectional view of the process cartridge 7 as viewed from the Z direction, where the process cartridge 7 is attached to the image forming apparatus 100 and the photosensitive drum 1 and developing roller 17 are in a contact state (attitude). The process cartridge 7 is made up of two units. One is the cleaning unit 13 where the photosensitive drum 1, charging roller 2, and cleaning blade 6 have been formed into a unit, and the other is the developing unit 4 having developing members such as the developing roller 17 and so forth.

The developing unit 4 has a developing frame 18 that supports various types of components within the developing unit 4. The developing unit 4 is provided with the developing roller 17 serving as a developing agent bearing member that rotates in the direction of the arrow D in FIG. 3 (counter-clockwise direction) while in contact with the photosensitive drum 1. The developing roller 17 is rotatably supported by the developing frame 18 at both ends thereof in the longitudinal direction (rotation axis direction) by developing bearings 19 (19R, 19L). The developing bearings 19 (19R, 19L) are attached to both side portions of the developing frame 18.

The developing unit 4 also has a developing agent storage chamber (hereinafter, "toner storage chamber") 18*a* and a developing chamber 18*b* where the developing roller 17 is disposed. Also disposed in the developing chamber 18*b* are a toner supply roller 20 serving as a developing agent supply member that rotates in the direction of the arrow E while in contact with the developing roller 17, and a developing blade 21 serving as a developing agent regulating member that regulates a toner layer on the developing roller 17. The developing blade 21 is fixed to and integrated with a fixing member 22 by welding or the like.

Disposed in the toner storage chamber 18*a* of the developing frame 18 is an agitating member 23 that agitates toner stored in the toner storage chamber 18*a*, and conveys the toner to the toner supply roller 20. The developing unit 4 is pivotably joined to the cleaning unit 13, centered on fitting shafts 24 (24R, 24L) that fit to holes 19Ra and 19La provided to the developing bearings 19R and 19L. The developing unit 4 also is urged in a direction where the developing roller 17 comes into contact with the photosensitive drum 1, by pressuring springs 25 (25R, 25L). Accordingly, when the process cartridge 7 is forming images, the developing unit 4 pivots (rotates) in the direction of arrow F centered on the fitting shafts 24, and the photosensitive drum 1 and developing roller 17 come into contact.

The cleaning unit 13 has a cleaning frame 14 serving as a frame that supports various types of components within the cleaning unit 13.

Figure 4:
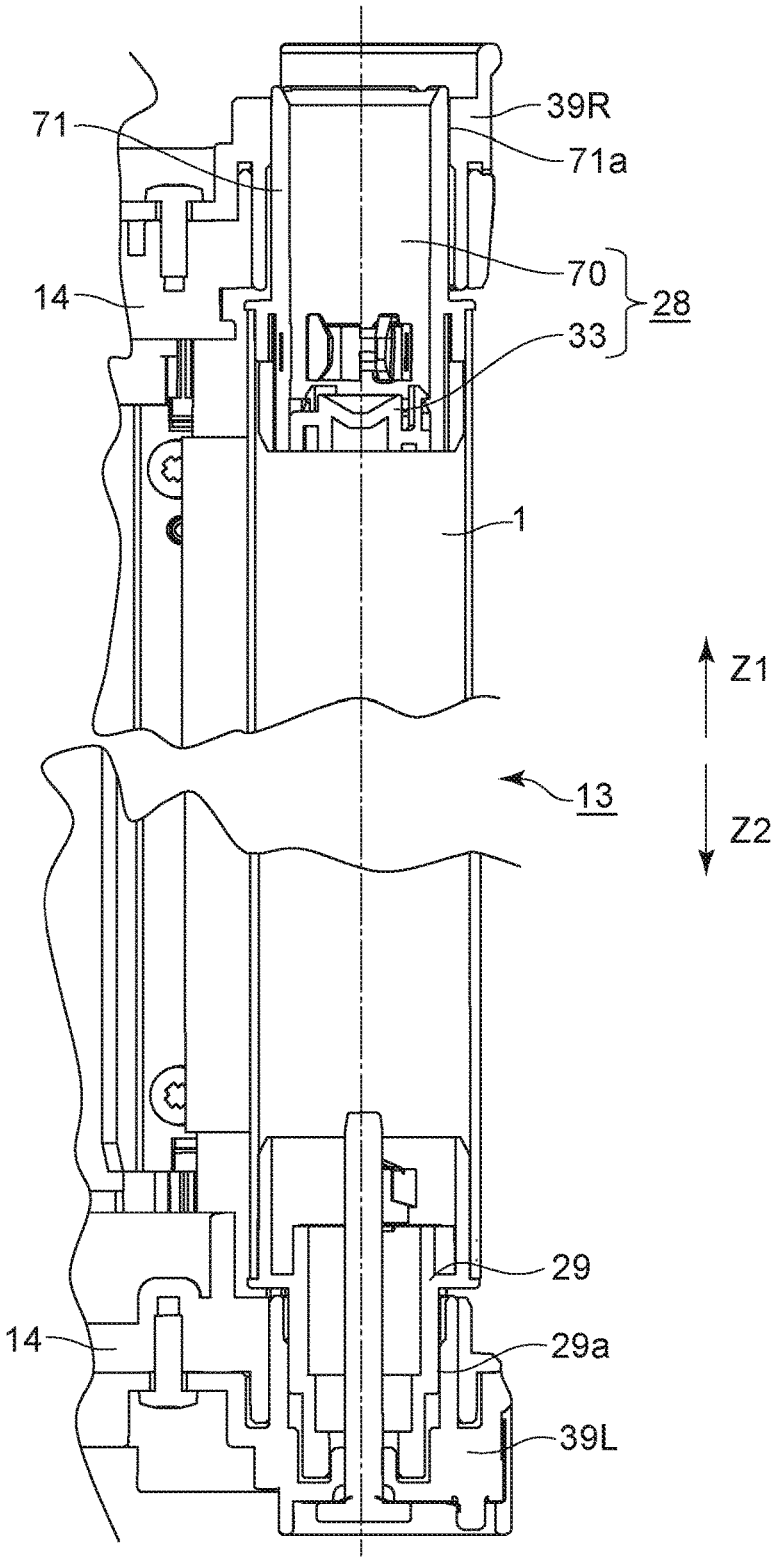
FIG. 4 is a cross-sectional view of the process cartridge, taken along to the rotation axis center (rotation axis line center) of the photosensitive drum.

FIG. 4 is a cross-sectional view of the process cartridge 7, taken along an imaginary plane including the rotation center of the photosensitive drum 1. Note that the side of the process cartridge 7 to which the portion (coupling member 28) that receives driving force from the image forming apparatus main body 100A is disposed (side in the Z1 direction) will be referred to as the drive side (backside) of the process cartridge 7. The side opposite to the "drive side" (side in the Z2 direction) will be referred to as the "non-drive side" (front side) of the process cartridge 7.

An electrode (electrode portion) that comes into contact with the inner face of the photosensitive drum 1 is provided at the opposite end side of the process cartridge 7 from the coupling member 28 (non-drive side end of the process cartridge 7). This electrode serves as a ground by coming into contact with the image forming apparatus main body 100A. The coupling member 28 is attached to one end of the photosensitive drum 1, and a non-drive side flange member 29 is attached to the other end of the photosensitive drum 1, thereby configuring a photosensitive drum unit 30. The photosensitive drum unit 30 receives driving force from the drive shaft 101 provided to the image forming apparatus main body 100A, via the coupling member 28. This coupling member 28 is configured so as to be detachably joined to the drive shaft 101. The coupling member 28 also is a flange member (drive side flange member) attached to the drive side end portion of the photosensitive drum 1.

The Z1 side of the coupling member 28 is cylindrical (cylindrical portion 71), as illustrated in FIG. 4. The cylindrical portion 71 protrudes farther in the Z1 side (outer side in the axial line direction) than the edge of the photosensitive drum 1. The outer peripheral portion of the cylindrical portion 71 is an outer periphery face 71*a*. A borne portion 71*c* is rotatably supported by a drum unit bearing member 39R. That is to say, the photosensitive drum unit 30 is rotatable by the borne portion 71*c* (see FIG. 7) being supported by the drum unit bearing member 39R.

In the same way, the non-drive side flange member 29 provided to the non-drive side of the photosensitive drum unit 30 is rotatably supported by a drum unit bearing member 39L. The non-drive side flange member 29 has a portion that has a cylindrical shape (cylindrical portion) protruding from the end of the photosensitive drum 1, and an outer periphery face 29*a* of the cylindrical portion is rotatably supported by the drum unit bearing member 39L. Note that the drum unit bearing member 39R is provided to the drive side of the process cartridge 7, and the drum unit bearing member 39L is provided to the non-drive side of the process cartridge 7.

When the process cartridge 7 is mounted to the image forming apparatus main body 100A, the drum unit bearing member 39R abuts a back-side cartridge positioning portion 108 provided to the image forming apparatus main body 100A, as illustrated in FIGS. 11A through 11D. Also, the drum unit bearing member 39L abuts a front-side cartridge positioning portion 110 of the image forming apparatus main body 100A. Thus, the cartridge 7 is positioned as to the image forming apparatus main body 100A. FIGS. 11A through 11D will be described in detail later.

As described above, the drum unit bearing members 39R and 39L are attached to both sides of the cleaning frame 14, each supporting the photosensitive drum unit 30. Accordingly, the photosensitive drum unit 30 is rotatably supported by the cleaning frame 14.

The charging roller 2 and cleaning blade 6 are also attached to the cleaning frame 14, and are disposed so as to come into contact with the surface of the photosensitive drum 1. Charging roller bearings 15 (15R, 15L) are also attached to the cleaning frame 14. The charging roller bearings 15 are bearing for supporting the shaft of the charging roller 2.

Now, the charging roller bearings 15 (15R, 15L) are attached so as to be capable of moving in the direction of arrow C in FIG. 3. A rotating shaft 2*a* of the charging roller 2 is rotatably attached to the charging roller bearings 15 (15R, 15L). The charging roller bearings 15 are urged toward the photosensitive drum 1 by a pressing spring 16 serving as an urging arrangement. Accordingly, the charging roller 2 comes into contact with the photosensitive drum 1, and the photosensitive drum 1 rotates, being driven thereby.

The cleaning frame 14 is provided with the cleaning blade 6 serving as a cleaning arrangement to remove toner remaining on the surface of the photosensitive drum 1. The cleaning blade 6 has a blade-shaped rubber member (elastic member) 6*a* that removes toner on the photosensitive drum 1 by coming into contact with the photosensitive drum 1, and a supporting plate 6*b* that supports the blade-shaped rubber member 6*a*, that have been integrated. The supporting plate 6*b* is fixed to the cleaning frame 14 by screws in the present embodiment.

The cleaning frame 14 has the opening 14*b* to recover transfer residual toner recovered by the cleaning blade 6, as described earlier. The opening 14*b* has a blowout prevention sheet 26 that comes into contact with the photosensitive drum 1 and seals between the photosensitive drum 1 and the opening 14*b*, thereby preventing leakage of toner in the upwards direction of the opening 14*b*.

The ease of maintenance is improved by this configuration where elements relating to image formation are integrated in a cartridge that is detachably mounted to the apparatus main body. In other words, maintenance of the apparatus can be easily performed by the user by detaching and mounting the process cartridge from and to the apparatus main body. Accordingly, an apparatus can be provided where maintenance can be easily performed not only by service staff but also be the user.

Configuration of Main Body

Figure 5:
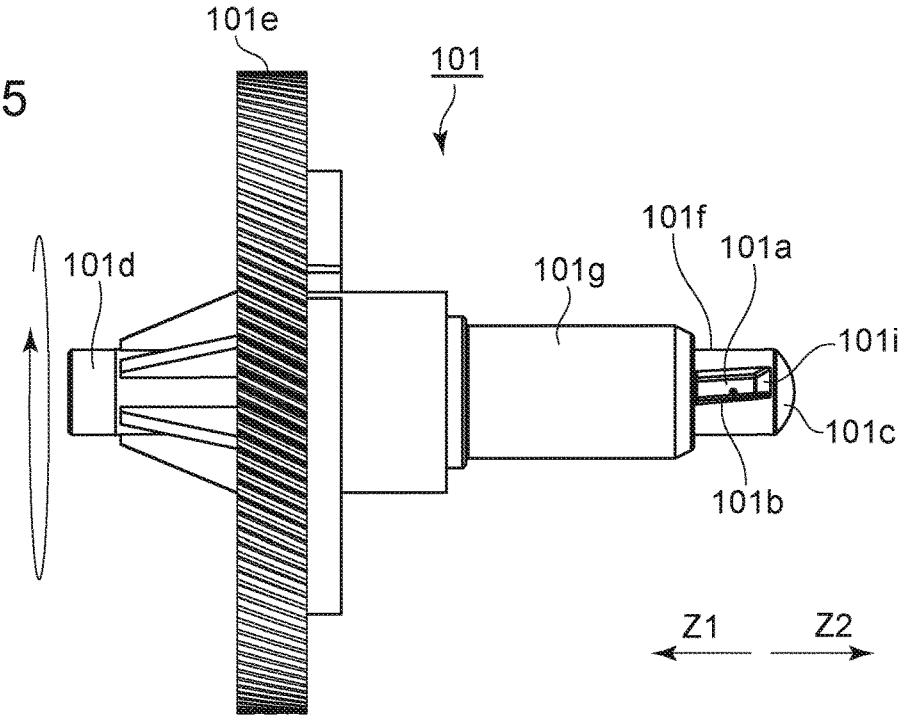
FIG. 5 is an external view of a main body drive shaft.
Figure 6:
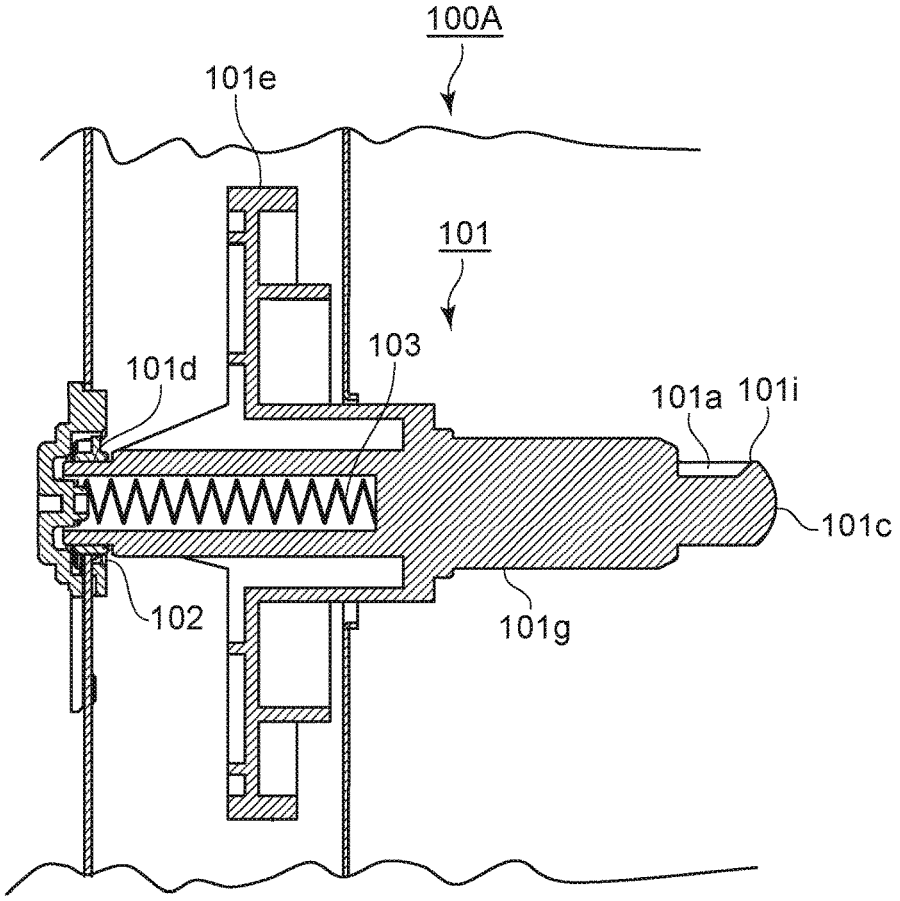
FIG. 6 is a cross-sectional view taken along to the rotation axis center (rotation axis line center) of a drive shaft in a state attached to the image forming apparatus main body.

The configuration of the drive shaft 101 will be described with reference to FIGS. 5 and 6. FIG. 5 is an external view of the main body drive shaft. FIG. 6 is a cross-sectional view, where the drive shaft 101 in a state of having been attached to the image forming apparatus main body, is cut along the rotation axis (rotation axis line) thereof. As illustrated in FIG. 5, the drive shaft 101 includes a gear portion 101*e*, a shaft portion 101*f*, a rough guide portion 101*g*, and a borne portion 101*d*.

A motor (omitted from illustration) is provided, serving as a drive source for the image forming apparatus main body 100A. Rotational drive force from this motor is received by the gear portion 101*e*, thereby rotating the drive shaft 101. Now, the rotational direction of the motor when forming images will be referred to as "forward rotation", and the direction of rotation in the opposite direction as "backward rotation". The motor can perform both forward rotation and backward rotation under control of signals from a control unit 300 (FIG. 1). The rotational direction of the drive shaft 101 when the motor is rotating forwards will be referred to as "forward rotation", and the rotational direction when the motor is rotating backwards will be referred to as "backward rotation". The control unit 300 has an electrical circuit that controls driving of the motor.

The drive shaft 101 has the shaft portion 101*f* having a rotatable projecting shape that projects farther toward the cartridge side along the rotation axial line than the gear portion 101*e*. The rotational drive force received from the motor is transmitted to the cartridge 7 via a groove-shaped drive force transmission groove 101*a* (recess, drive handover portion) provided to the shaft portion 101*f*. The shaft portion 101*f* also has a half-sphere shape 101*c* at the tip thereof.

This drive force transmission groove 101*a* of the main unit is configured such that part of a later-described engaging portion 73 can enter therein. The drive force transmission groove 101*a* also has a drive force transmission face (first engaging portion) 101*b* serving as a face that comes into contact with a drive force receiving face 73*c* of the coupling member 28 and transmits drive force.

The borne portion 101*d* is disposed on the opposite side of the gear portion 101*e* from the rough guide portion 101*g*, as illustrated in FIG. 6. The borne portion 101*d* is rotatably supported by a bearing member 102 provided to the image forming apparatus main body 100A.

As illustrated in FIG. 6, the drive shaft 101 is urged toward the cartridge 7 by a spring member 103 of the image forming apparatus main body 100A. Note however, that the moveable amount (space) of the drive shaft 101 in the Z direction is around 1 mm, which is sufficiently smaller than the width of the later-described drive force receiving face 73*c* in the Z direction.

Configuration of Coupling Member

Figure 7:
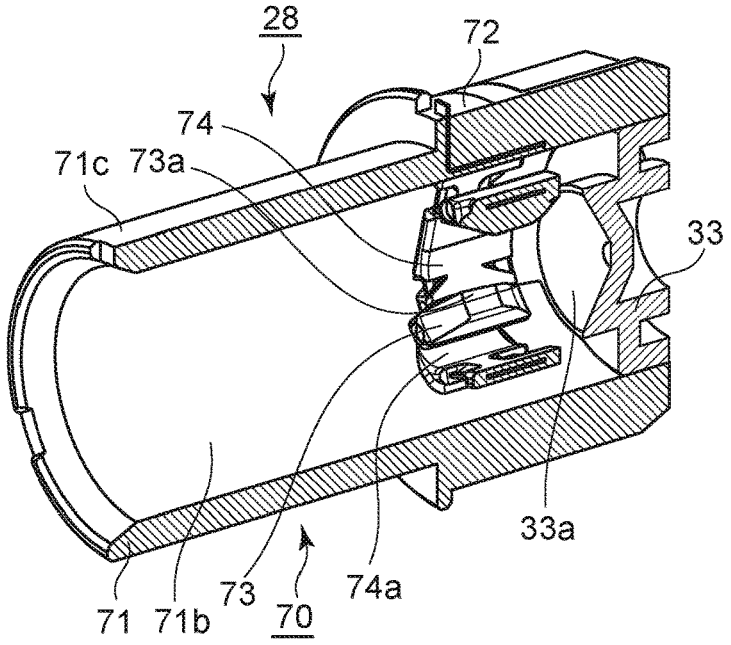
FIG. 7 is a cutaway perspective view of a coupling member.
Figure 8:
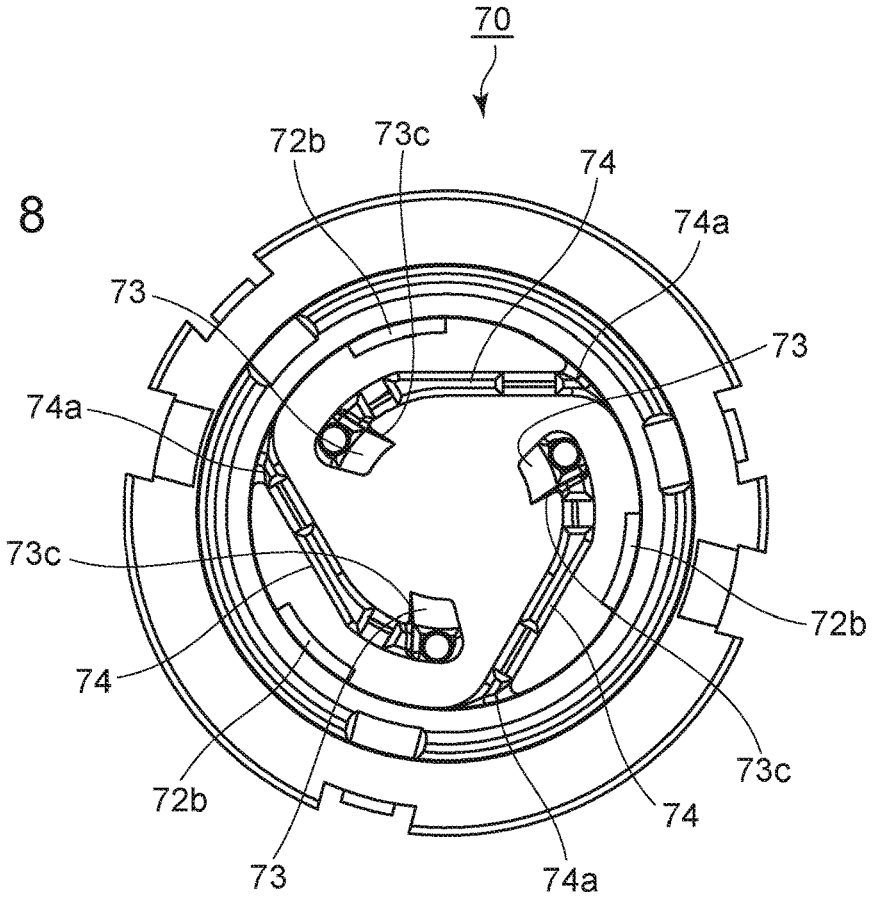
FIG. 8 is a diagram viewing a flange member in a Z direction from the outer side.
Figure 9:
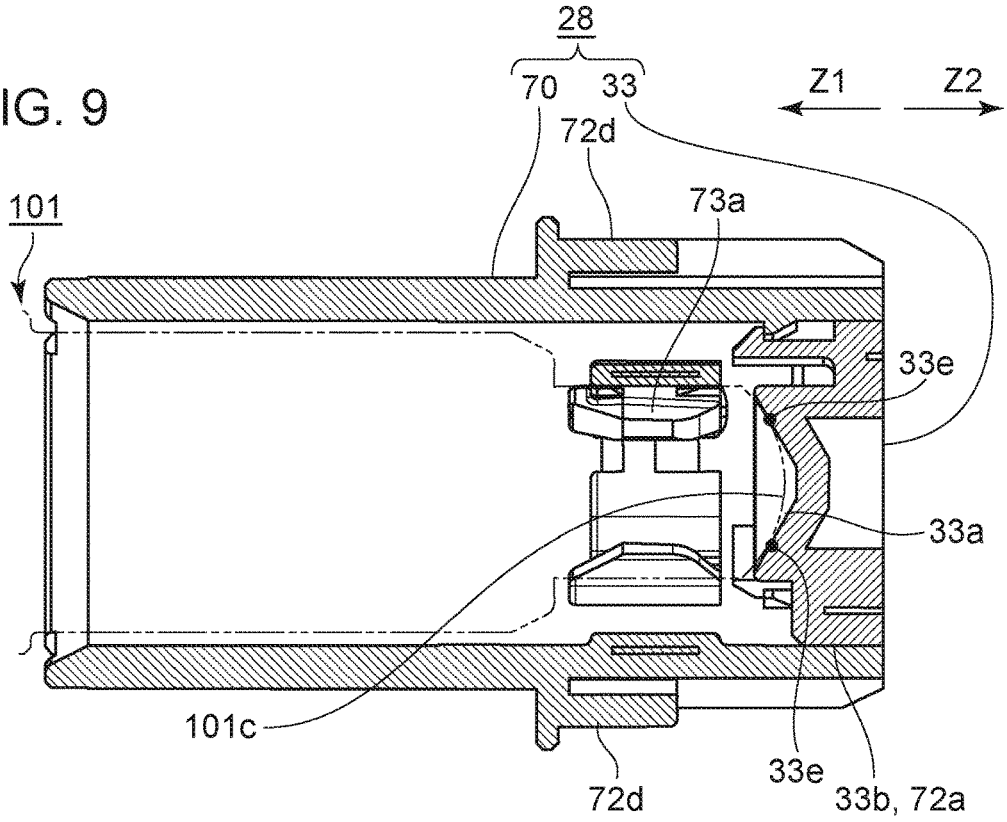
FIG. 9 is a cross-sectional view of the coupling member.

The configuration of the coupling member will be described with reference to FIGS. 7 through 9. FIG. 7 is a cross-sectional perspective view of the coupling member 28. FIG. 8 is a diagram viewing the flange member 70 from the outer side in the Z direction. FIG. 9 is a cross-sectional view of the coupling member 28.

The coupling member 28 has the cylindrical portion 71, an attachment portion 72, the engaging portion 73, a base portion 74, and an alignment portion 33, as illustrated in FIG. 7. The attachment portion 72 is a member for being attached to the photosensitive drum 1, and is fixed to the photosensitive drum 1 by way of press fitting, swaging, or the like. The cylindrical portion 71 is almost cylindrical in shape. The cylindrical portion 71 has the borne portion 71*d* as described earlier, and the borne portion 71*d* is rotatably supported by the drum unit bearing member 39R.

Multiple engaging portions 73 and multiple base portions 74 are symmetrically provided to the flange member 70, as illustrated in FIG. 8. That is to say, the engaging portions 73 are disposed at three positions in the circumferential direction of the flange member 70. In the same way, the base portions 74 are also disposed at three positions in the circumferential direction of the flange member 70.

The engaging portions (second engaging portion) 73 each have a protruding portion (protrusion, projecting portion) that protrudes toward the inner side of the flange member 70 in the radial direction (radial direction of drum unit). The engaging portions 73 are disposed at the tips of the base portions 74. The engaging portions 73 are designed to be disposed at three equidistant positons in the circumferential direction of the flange member 70 (at 120° intervals).

The engaging portions 73 are configured so as to be angle to engage the drive shaft 101. The engaging portions 73 each have a drive force receiving face 73*c* that receives drive force (rotation force) to rotate the photosensitive drum 1. The drive force receiving face 73*c* is a portion that receives drive force (rotation force) from outside the drum unit (outside of the process cartridge), i.e., from the apparatus main body.

The ends (back ends) of the base side of the base portions 74 are joining portions that join the flange member 70. The back ends of the base portion 74 also are root portions 74*a* of the base portions 74 serving as supported portions that are supported by the flange member 70. The base portions 74 can at least move the engaging portions 73 in the radial direction of the flange member 70 by deforming. Note that the radial direction of the flange member 70 is perpendicular to the rotation axis line of the drive shaft 101. Due to this movement in the radial directions, the engaging portions 73 are able to move between an engageable position where the drive force transmission face 101*b* can be engaged, and a non-engageable position where the drive force transmission face 101*b* cannot be engaged. In the present embodiment, the engaging portions 73 are one of multiple engaging portions.

The alignment portion 33 has an inverse conical portion 33*a* and a fitting portion 33*b*, as illustrated in FIG. 9. The fitting portion 33*b* fits to an inner peripheral face 72*a* of the flange member 70, and is engaged by way of snap-fitting or the like, thereby forming the coupling member 28. The inverse conical portion 33*a* also has a contact portion 33*e* that comes into contact with the half-sphere shape 101*c* that is the half-sphere shape at the tip of the drive shaft 101 when rotationally driving the photosensitive drum 1. The multiple engaging portions (second engaging portions) 73 are the one of multiple engaging portions, in the present embodiment, and the multiple drive force transmission faces 101*b* (first engaging portions) are the other of multiple engaging portions.

Mounting Cartridge to Image Forming Apparatus Main Body

Figure 10:
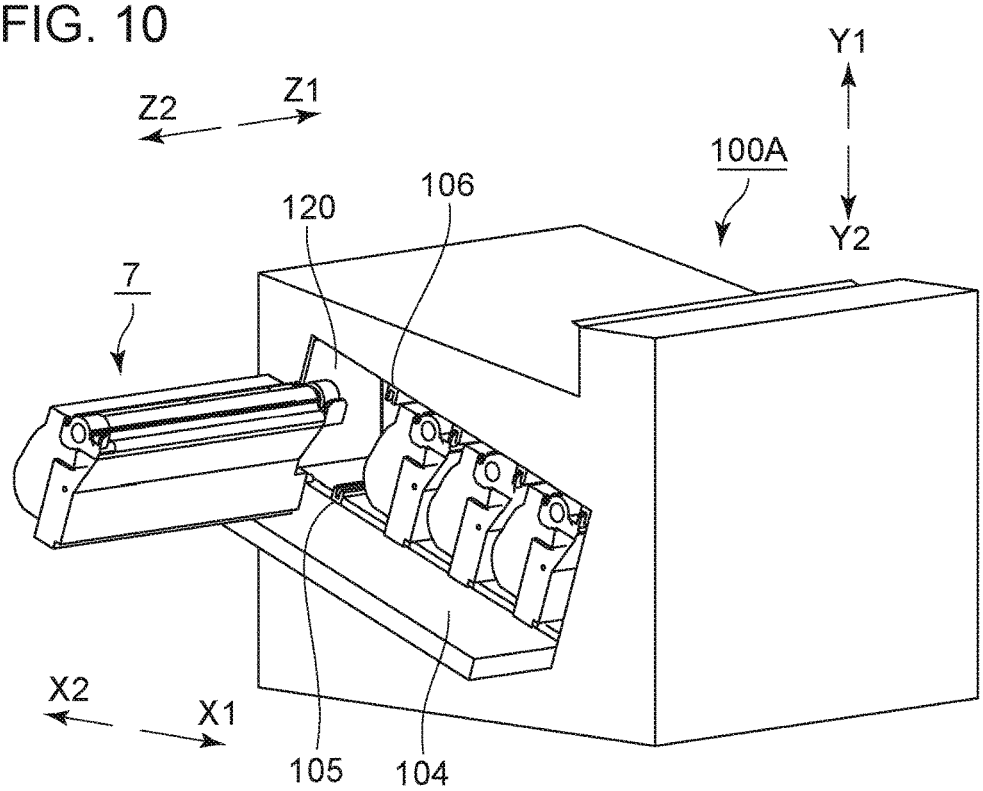
FIG. 10 is a perspective view for describing mounting the process cartridge to an image forming apparatus main body.
Figure 11A:
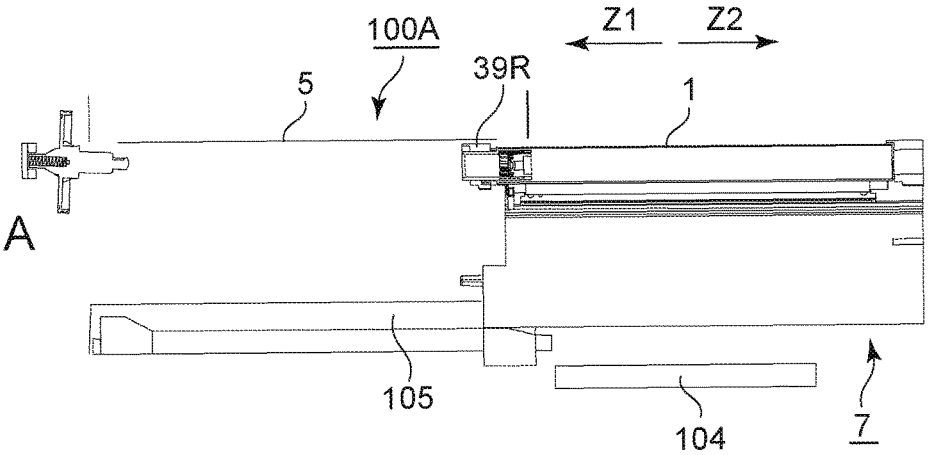
FIGS. 11A through 11D are cross-sectional views view for describing mounting operations of the process cartridge to the image forming apparatus main body.

Mounting the process cartridge 7 to the image forming apparatus main body 100A will be described with reference to FIGS. 10 through 11D. FIG. 10 is a perspective view for describing mounting of the cartridge 7 to the image forming apparatus main body 100A. FIGS. 11A through 11D are cross-sectional view for describing mounting of the cartridge 7 to the image forming apparatus main body 100A.

A cartridge door (opening/closing member) 104 of the image forming apparatus main body 100A is provided so as to be capable of opening/closing an opening 120 by which cartridges are detachably mountable, as illustrated in FIG. 10. The cartridge door 104 is in an open position where the opening 120 is open, in the state illustrated in FIG. 10. Opening the cartridge door 104 reveals a space in which a cartridge lower-guide rail 105 that guides the cartridge 7 is disposed on the lower face, and a cartridge upper-guide rail 106 is disposed on the upper face. The cartridge 7 is guided to a mounting position by the upper and lower guide rails (105, 106) provided at the top and bottom of the space. The cartridge 7 is inserted to the mounting position generally following the axial line of the photosensitive drum unit 30.

The mounting operation of the cartridge 7 to the image forming apparatus main body 100A will be described below with reference to FIGS. 11A through 11D. The drum unit bearing member 39R and photosensitive drum 1 are not in contact with the intermediate transfer belt 5 at the time of starting insertion of the cartridge 7, as illustrated in FIG. 11A. In other words, the dimensional relationship is such that the photosensitive drum 1 does not come into contact with the intermediate transfer belt 5 is a state where the end of the back side the cartridge 7 in the insertion direction is supported by the cartridge lower-guide rail 105.

Figure 11B:
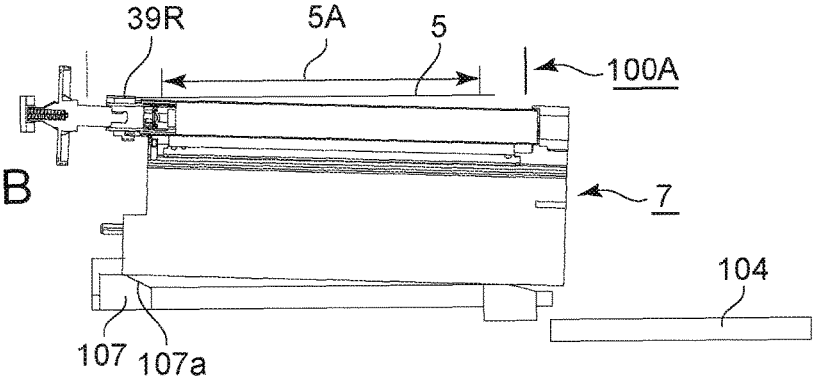

The image forming apparatus main body 100A has a back-side cartridge lower guide 107 protruding further upwards in the gravitational direction than the cartridge lower-guide rail 105, at the back side of the cartridge lower-guide rail 105 in the insertion direction, as illustrated in FIG. 11B. This back-side cartridge lower guide 107 has a tapered face 107*a* at the front side in the insertion direction of the cartridge 7. As the cartridge 7 is begin inserted, the cartridge 7 rides up on the tapered face 107*a* and is guided to the mounting position.

It is sufficient for the position and shape of the back-side cartridge lower guide 107 to be such that part of the cartridge 7 does not rub against an image forming region 5A of the intermediate transfer belt 5 when inserting the cartridge 7 into the image forming apparatus main body 100A. The image forming region 5A is a region of the intermediate transfer belt 5 where a toner image to be transferred to the recording material 12 is borne. The drum unit bearing member 39R at the back side of the cartridge 7 in the insertion direction protrudes farther upwards in the gravitational direction than any other part of the cartridge 7 in the mounted attitude in the present embodiment. Accordingly, it is sufficient for the layout and shapes of the components to be appropriately selected such that a path that the end of the drum unit bearing member 39R at the back-most side in the insertion direction follows during insertion (hereinafter referred to as "insertion path") does not interfere with the image forming region 5A.

Figure 11C:
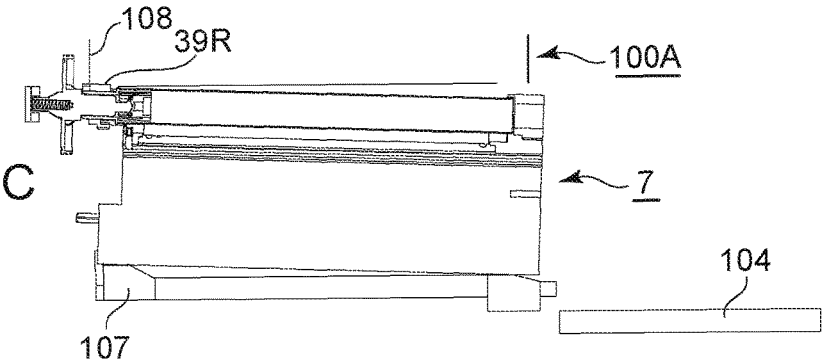
Figure 11D:
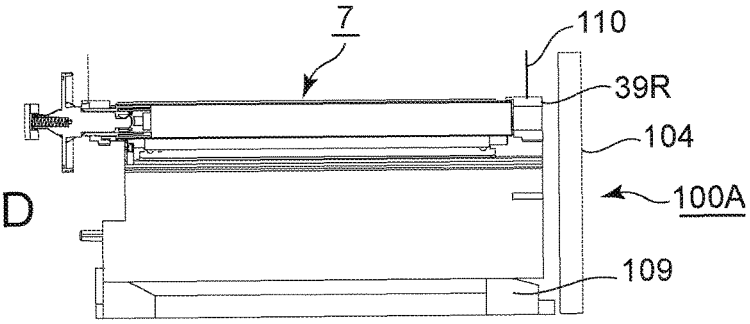

Thereafter, the cartridge 7 is further inserted to the back side to the image forming apparatus main body 100A from the state where it has ridden up on the back-side cartridge lower guide 107, as illustrated in FIG. 11C. The drum unit bearing member 39R then abuts the back-side cartridge positioning portion 108 provided to the image forming apparatus main body 100A. The cartridge 7 (photosensitive drum unit 30) is at this time at a state inclined by around 0.5 to 2° from the state where mounting to the image forming apparatus main body 100A is completed (FIG. 11D). That is to say, the state is such that the downstream side of the cartridge 7 in the insertion direction (photosensitive drum unit 30) is lifted up above the upstream side.

FIG. 11D is a diagram illustrating the state of the apparatus main body 100A and the cartridge 7 with the cartridge door 104 closed. That is to say, the cartridge door 104 is in a closed position where the opening 120 is closed. The image forming apparatus main body 100A has a front-side cartridge lower guide 109 at the front side of the cartridge lower-guide rail 105 in the insertion direction. This front-side cartridge lower guide 109 is configured to move up and down in conjunction with the cartridge door (front door) 104 being opened and closed.

When a user closes the cartridge door 104, the front-side cartridge lower guide 109 rises. The drum unit bearing member 39L then comes into contact with the front-side cartridge positioning portion 110 of the image forming apparatus main body 100A, and the cartridge 7 is positioned as to the image forming apparatus main body 100A. Thus, mounting of the cartridge 7 to the image forming apparatus main body 100A is completed by the above actions.

Process of Engaging Coupling Member to Main Body Drive Shaft

Figure 12A:
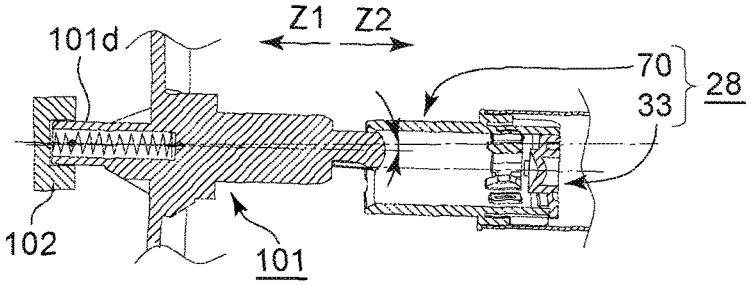
FIGS. 12A through 12E are cross-sectional views view for describing mounting operations of the drive shaft to the coupling member.
Figure 12B:
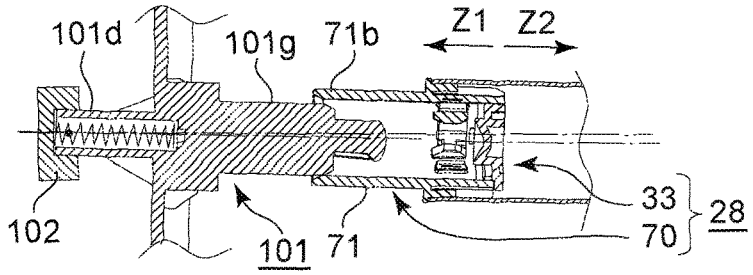
Figure 12C:
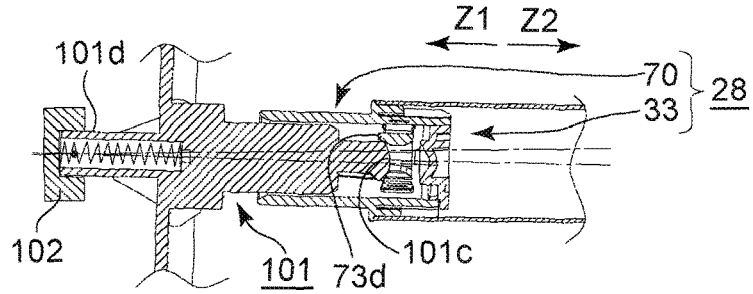
Figure 12D:
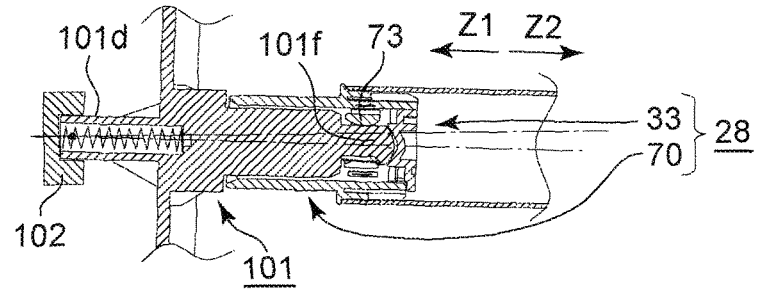
Figure 12E:
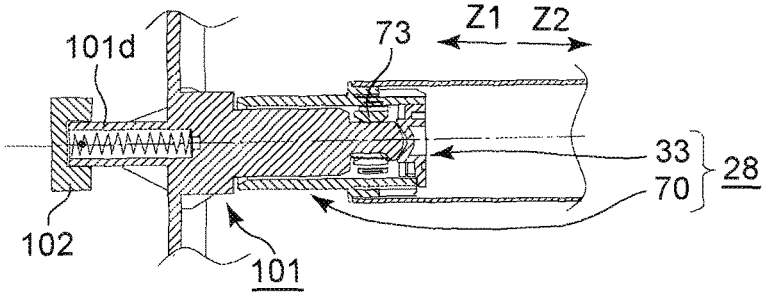

Next, the process of engaging the coupling member 28 and drive shaft 101 will be described in detail with reference to FIGS. 12A through 12E. FIGS. 12A through 12E are cross-sectional view for describing the mounting operations of the coupling member 28 to the drive shaft 101 of the main body. FIG. 12A is a diagram illustrating a state in which engaging of the coupling member 28 and drive shaft 101 has started. FIG. 12E is a diagram illustrating a state in which the cartridge 7 has been mounted to the image forming apparatus main body 100A, the cartridge door 104 is closed to raise the front-side cartridge lower guide 109, and the cartridge 7 has been positioned as to the image forming apparatus main body 100A. FIGS. 12B through 12D are diagrams for describing the mounting processes of the coupling member 28 and drive shaft 101, between FIGS. 11A and 12E. Note that the drive shaft 101 sags downwards in the gravitational direction by a minute angle under its own weight.

Figure 13A:
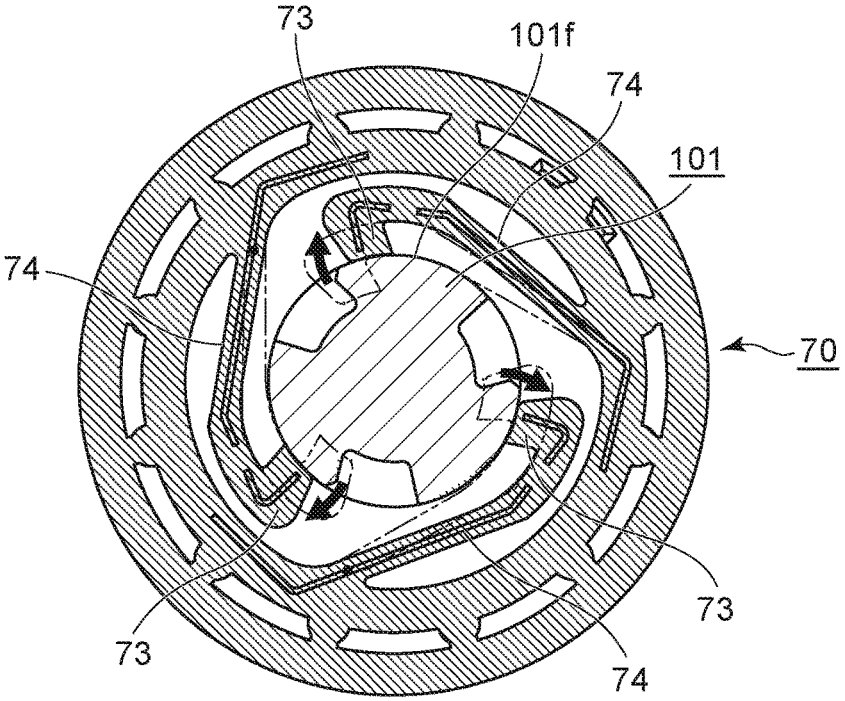
FIGS. 13A and 13B are cross-sectional views view for describing mounting operations of the drive shaft to the coupling member.
Figure 13B:
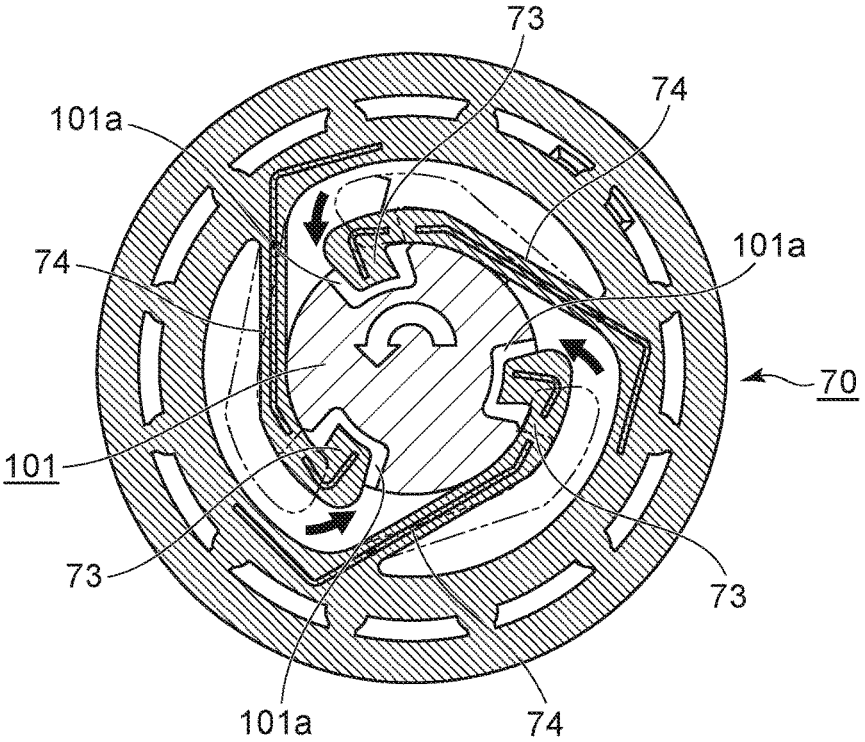

FIGS. 13A and 13B are diagrams for describing a state where the phase of the main body drive force transmission grooves 101*a* and the phase of the engaging portions 73 are not matched. That is to say, in FIG. 13A, the engaging portions 73 are not able to enter inside the drive force transmission grooves 101*a* of the main body, and the two are not engaged. The position of the engaging portions 73 in the radial direction at this time will be referred to as "unengaged position". A state where the two are not engaged is a state where the drive force transmission faces 101*b* and drive force receiving faces 73*c* are not in contact.

The coupling member 28 is fit onto the drive shaft 101 in a state inclined by 0.5 to 2° as to the state where the cartridge 7 has been positioned as to the image forming apparatus main body 100A (illustrated in FIG. 12E), as illustrated in FIG. 12A.

As illustrated in FIG. 12B, an inner peripheral face 71*b* of the cylindrical portion 71 of the flange member 70 first comes into contact with the rough guide portion 101*g* of the drive shaft 101. The coupling member 28 is fit onto the drive shaft 101 with the rough guide portion 101*g* of the drive shaft 101 following the inner peripheral face 71*b* of the flange member 70.

When the coupling member 28 is further fit onto the drive shaft 101 toward the back side of the drive shaft 101 from the state in FIG. 12B, insertion tapered faces 73*d* of the engaging portions 73 abut the half-sphere shape 101*c* at the tip of the drive shaft 101, as illustrated in FIG. 12C. The drive shaft 101 is guided to the generally middle portion of the three engaging portions 73 by the inclined faces of the insertion tapered faces 73*d* and the spherical shape of the half-sphere shape 101*c*.

When the coupling member 28 is further fit onto the drive shaft 101, the base portions 74 exhibit elastic deformation toward the outer side in the radial direction, with the engaging portions 73 following the half-sphere shape 101*c*. As a result, the engaging portions 73 move (retract) to the outer diameter portion of the shaft portion 101*f* of the drive shaft 101, as illustrated in FIG. 13A.

Thereafter, the cartridge 7 is lifted upwards so that the drum unit bearing member 39L of the cartridge 7 abuts the front-side cartridge positioning portion 110. Lifting the cartridge 7 upwards positions the cartridge 7 to the image forming apparatus main body 100A (illustrated in FIG. 11D). This action of the cartridge 7 resolves the inclination of the coupling member 28, as illustrated in FIG. 12E. That is to say, the coupling member 28 and drum unit 30 have assumed an attitude where image formation can be performed. At this point, the rotation axis lines of the drive shaft 101 and the coupling member 28 are parallel to the Z direction.

In a case where the phases of the main body drive force transmission grooves 101*a* and the engaging portions 73 match, the elastic deformation of the base portions 74 is at least partially resolved at the stage of FIG. 12D and the state in FIG. 13B is achieved. That is to say, the base portions 74 deform so as to move the engaging portions 73 toward the inner side in the radial direction when transitioning from the state in FIG. 13A to the state in FIG. 13B.

Thus, the base portions 74 cause the engaging portions 73 to enter into the main body drive force transmission grooves 101*a*, in a state engageable with the drive force transmission faces 101*b*. The position of the engaging portions 73 in the radial direction at this time will be referred to as "engageable position". When the drive shaft 101 rotates from this state, the engaging portions 73 come into contact with the drive force transmission faces 101*b* and are engaged.

Preparatory Operations after Mounting Cartridge

Figure 14A:
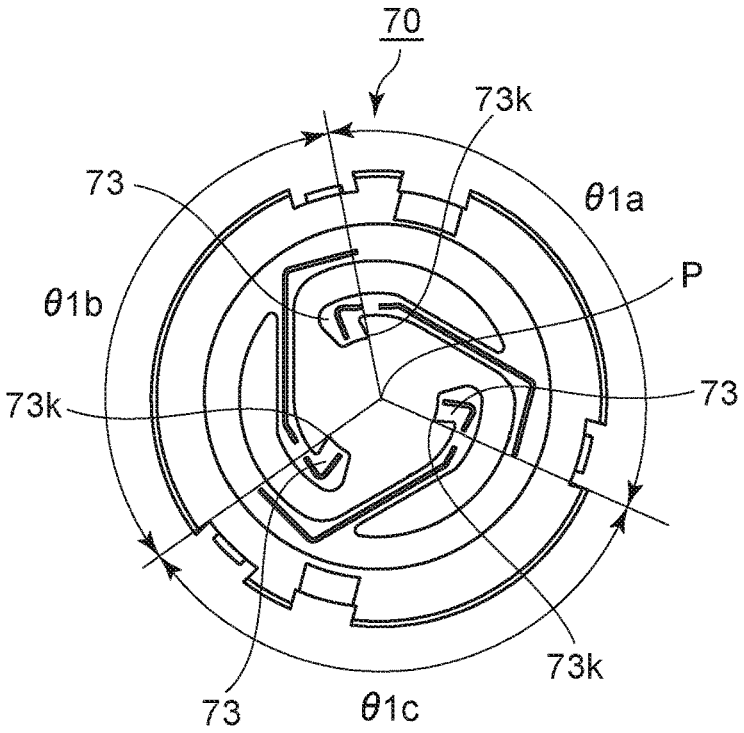
FIGS. 14A and 14B are cross-sectional view of the coupling member and drive shaft, taken along a direction perpendicular to the rotation center (rotation axis line).
Figure 14B:
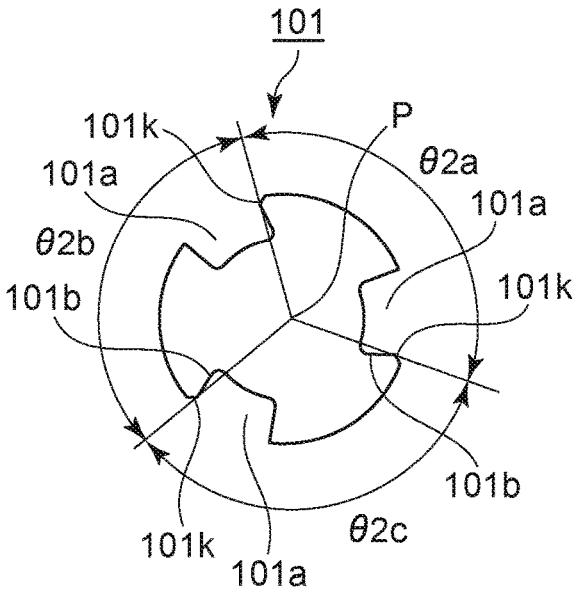
Figure 16A:
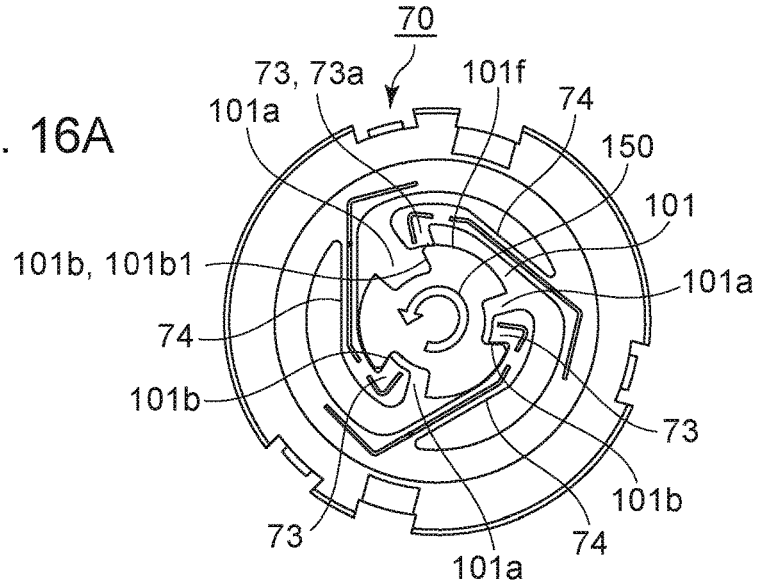
FIGS. 16A through 16C are cross-sectional views of the flange member and drive shaft, taken along a direction perpendicular to the rotation center (rotation axis line).
Figure 16B:
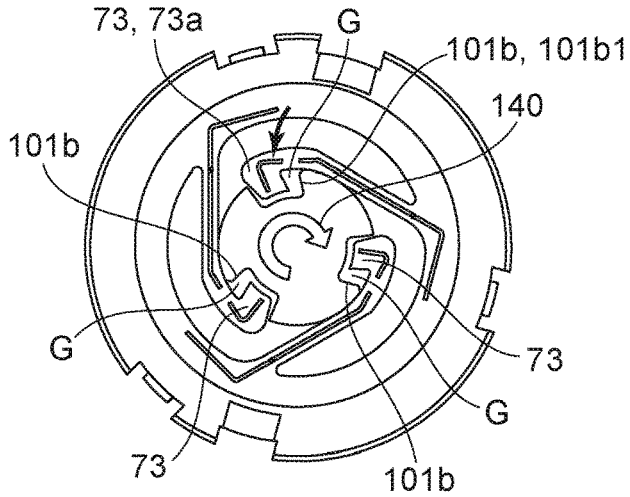
Figure 16C:
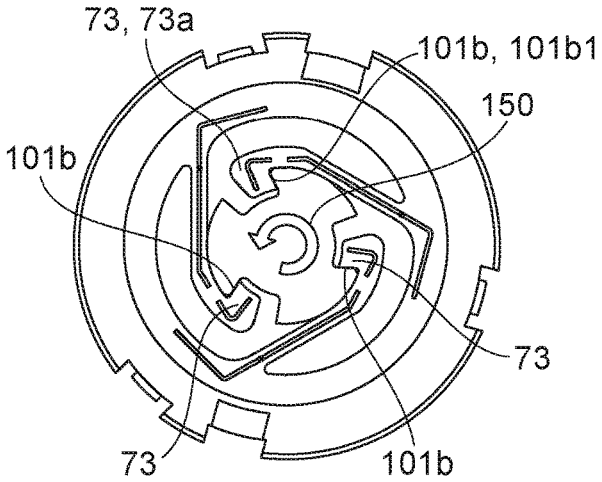

Preparatory operations performed before forming images after having mounted the cartridge 7 to the image forming apparatus main body 100A will be described in detail with reference to FIGS. 14A and 14B, and FIGS. 16A through 16C. Note that the following description will be made assuming that the rotation axis lines of the drive shaft 101 and coupling member 28 are parallel to the Z direction. FIGS. 14A and 14B are cross-sectional views (X-Y cross-sections) taken along planes perpendicular to the Z direction on the coupling member 28 and drive shaft 101, respectively. The X-Y cross-sections are a plane orthogonal to the rotation axis line of the coupling member 28 and a plane orthogonal to the rotation axis line of the drive shaft 101. FIGS. 16A through 16C are cross-sectional views (X-Y cross-sections) taken along planes perpendicular to the Z direction on the drive shaft 101 and coupling member 28.

Actions where the drive shaft 101 is subjected to forward rotation and backward rotation as preparatory operations to engage the engaging portions 73 and the drive force transmission faces 101*b* will be referred to as preparatory forward rotation (forward rotation step) and preparatory backward rotation (backward rotation step), respectively. These preparatory operations are rotation control operations executed by the control unit 300.

In a state where the cartridge 7 is mounted to the image forming apparatus 100, the positional relationship between the engaging portions 73 of the coupling member 28 and the main body drive force transmission faces 101*b* of the drive shaft 101 is not uniquely determined, so various positional relationships can be assumed.

In this state, the control unit 300 runs a motor (omitted from illustration) as preparatory forward rotation, and causes forward rotation of the drive shaft 101 (direction of arrow 150 in FIG. 16A) by an angle α. The angle α is set to an angle where at least one engaging portion 73 and drive force transmission face 101*b* can engage.

Now, multiple engaging portion tips 73*k*, and multiple tips 101*k* of the drive force transmission faces 101*b*, are each laid out equidistantly in the circumferential direction at θ1=θ2=360/N (degrees). N is the number of engaging portions 73 and the number of drive force transmission faces 101*b* (N=3 in the present embodiment). However, there will be slight error in the above θ1 and θ2, due to variance in manufacturing, such as mold precision, molding shrinkage, machining precision, and so forth.

Accordingly, there are cases where rotation by the angle α is performed as preparatory forward rotation as described above, but the state is such as that illustrated in FIG. 16A. That is to say, there are cases where a part of the engaging portions 73 has ridden up on the shaft portion 101*f* and is not engaging the corresponding part of the drive force transmission faces 101*b*, while the remaining engaging portions 73 are engaging the corresponding drive force transmission faces 101*b*. The engaging portion 73 that has ridden up will be referred to as a "first unengaged engaging portion 73*a*", and the drive force transmission face 101*b* corresponding to this first unengaged engaging portion 73*a* will be referred to as a "second unengaged engaging portion 101*b*1". A state where such a first unengaged engaging portion 73*a* and second unengaged engaging portion 101*b*1 exist, and the remaining engaging portions 73 and drive force transmission faces 101*b* are engaged, will be referred to as a "partially engaged state". Even if further forward rotation of the drive shaft 101 is performed, part of the engaging portions 73 and drive force transmission faces 101*b* are engaged, so drive force is transmitted and the coupling member 28 also rotates forward. This means that there is a possibility that no amount of forward rotation (no matter how great the angle α is) can cause the part of the engaging portions 73 that has ridden up on the shaft portion 101*f* to engage the corresponding part of the drive force transmission faces 101*b*, and the partially engaged state will be maintained.

However, performing forward rotation in such a partially engaged state and forming images in the partially engaged state may result in defective images, since the rotational precision of the coupling member 28 is poor. Moreover, performing forward rotation in a partially engaged state concentrates force on part of the engaging portions 73 and drive force transmission faces 101*b*, which may damage the coupling member 28 and/or the drive shaft 101. Accordingly, the control unit 300 performs control in the present embodiment where, after having performed forward rotation of the drive shaft 101 by the angle α as preparatory forward rotation, performs backward rotation by an angle β as preparatory backward rotation.

Next, the control unit 300 runs the motor (omitted from illustration) and performs backward rotation (direction of arrow 140 in FIG. 16B) by angle β. The angle β of the drive shaft 101 is set to an angle where the first unengaged engaging portion 73*a* that has ridden upon the shaft portion 101*f* can enter the second unengaged engaging portion 101*b*1. The first unengaged engaging portion 73*a* is any engaging portion 73 that has not engaged any drive force transmission face 101*b* after forward rotation of angle α (FIG. 16A). The angle β accordingly is set to an angle where the second unengaged engaging portion 101*b*1 that is upstream of the first unengaged engaging portion 73*a* in the backward rotation direction (direction of arrow 140) of the drive shaft 101 can move to the downward side of that first unengaged engaging portion 73*a*.

Accordingly, performing preparatory backward rotation enables any engaging portion 73 riding up on the shaft portion 101*f* to enter a drive force transmission groove 101*a*, and be in a state where there is a gap G between the engaging portions 73 and the main body drive force transmission faces 101*b*, as illustrated in FIG. 16B. Thus, when a forward rotation operation (direction of arrow 150 in FIGS. 16A and 16C) is performed next for image formation, all engaging portions 73 can be made to engage the main body drive force transmission faces 101*b*, as illustrated in FIG. 16C. In this way, in a state where the preparatory backward rotation illustrated in FIG. 16B has been completed, each of all drive force transmission faces 101*b* is situated upstream in the forward rotation direction of the drive shaft 101 (backward direction of arrow 150) from the engaging portion 73 to which it will be engaged with in the end (corresponding engaging portion 73). In FIG. 16B, the engaging portion with which the second unengaged engaging portion 101*b*1 will be engaged in the end is the first unengaged engaging portion 73*a*. Accordingly, all engaging portions 73 and main body drive force transmission faces 101*b* can be engaged by subsequently performing forward rotation operations.

Next, setting of the rotational angle α in preparatory forward rotation and setting of the rotational angle β in preparatory backward rotation will be described in detail. The tips 73*k* of the three engaging portions 73 are designed so as to be placed every design value θ1 in the circumferential direction centered on a rotation axis line center P1, which is 120 degrees, obtained by equally dividing 360 degrees by three. This can be expressed by θ1=360/N°, where N is a natural numeral representing the number of engaging portions 73.

On the other hand, in reality there will be slight error in the placement intervals in the circumferential direction of the tips 73*k* of the engaging portions 73, due to variance in manufacturing, such as mold precision, molding shrinkage, machining precision, and so forth. That is to say, the placement intervals of the tips 73*k* of the engaging portions 73 in the circumferential direction will be θ1a, θ1b, θ1c (≈θ1), as illustrated in FIG. 14A. The difference between a maximum value θ1max of θ1a, θ1b, θ1c in a tolerance range, and the design value θ1, will be expressed as Δθ1.

In the same way, boundary positions (tips) 101*k* of the three drive force transmission faces 101*b* are designed so as to each be placed every design value θ2 in the circumferential direction centered on the rotation axis line center P, which is 120 degrees, obtained by equally dividing 360 degrees by three. This can be expressed by θ2=360/N°, where N is a natural numeral representing the number of drive force transmission faces 101*b*. However, in reality there will be slight deviation in the placement intervals in the circumferential direction of the tips 101*k*, due to variance in manufacturing, such as mold precision, molding shrinkage, machining precision, and so forth. That is to say, the placement intervals of the tips 101*k* in the circumferential direction will be θ2a, θ2b, θ2c (≈θ2), as illustrated in FIG. 14B. The difference between a maximum value θ2max of θ2a, θ2b, θ2c in a tolerance range, and the design value θ2, will be expressed as Δθ2.

Figure 15:
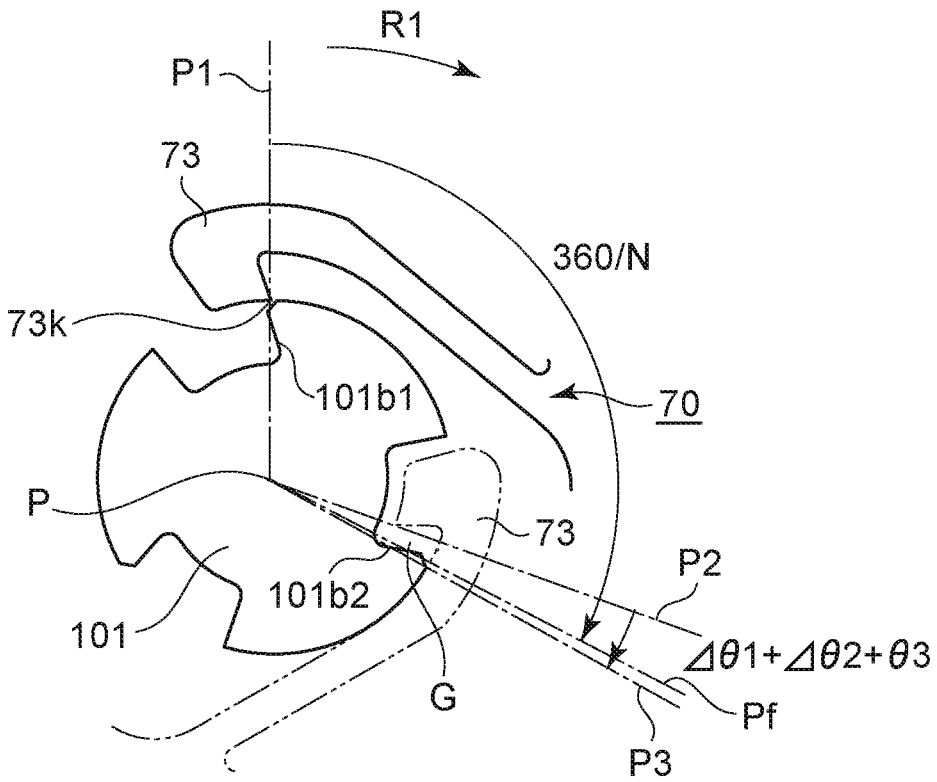
FIG. 15 is a cross-sectional view of the flange member and drive shaft, taken along a direction perpendicular to the rotation center (rotation axis line).

First, the rotational angle α will be described with reference to FIG. 15. FIG. 15 is a cross-sectional view (X-Y cross-section) of the drive shaft 101 and coupling member 28 taken along a plane perpendicular to the Z direction. The engaging portion 73 drawn using solid lines in FIG. 15 represents a state in which the engaging portion 73 narrowly is unable to engage a second unengaged engaging portion (drive force transmission face) 101*b*1, where the tip 73*k* is at a rotational phase P1. Forward rotation of the drive shaft 101 by 360/N° from this state rotates the engaging portion 73 in the R1 direction as seen from the drive shaft 101. The state of the engaging portion 73 then becomes that drawn using dashed lines, and the tip 73*k* transitions to a rotational phase P2. The angle between the rotational phase P2 and rotational phase P1 at this time is smaller than 360/N°. That is to say, the rotational angle P2 is on the upstream side from an imaginary phase Pf 360/N° from the rotational phase P1. The reason is that when the engaging portion 73 deforms and moves in the radial direction of the rotation center P of the drive shaft 101, the tip 73*k* moves in the circumferential direction as well. Accordingly, in a state where the drive shaft 101 has been rotated forward by 360/N°, a gap G is present between the tip 73*k* and a drive force transmission face 101*b*2, as illustrated in FIG. 15. The tip needs to be further rotated forward by (Δθ1+Δθ2+θ3)° in order to come into contact with the drive force transmission face 101*b*2.

The angle θ3 is decided by angle θ3a° and angle θ3b°. Angle θ3a° is the amount of movement (movement angle) of relative movement of the tip 73*k* as to the base portion 74 when the engaging portion 73 deforms and moves in the radial direction of the rotation center P of the drive shaft 101. If a configuration is made such that the tip 73*k* does not move in the circumferential direction when the engaging portion 73 deforms and moves in the radial direction of the rotation center P of the drive shaft 101, the amount of movement is 0°. In a case where the tip 73*k* moves toward the upward side relative as to the base portion 74, in the R1 direction in FIG. 15 (a case of moving away from the drive force transmission face 101*b*2 in the circumferential direction), the amount of movement is a positive value.

The angle θ3b° is a value decided by a plane angle correction value θ3b° dependent on the angle of the drive force transmission face 101*b* as to the radial direction. If the angle of the drive force transmission face 101*b* as to the radial direction is 0°, the plane angle correction value θ3b° is 0°. If the drive force transmission face 101*b* is inclined heading in the downstream side in the R1 direction toward the center P in the radial direction, the value is a positive value.

Thus, in a case where the tip 73*k* is at the rotational phase P1 and narrowly is not engaging the second unengaged engaging portion (drive force transmission face) 101*b*1, the tip 73*k* can be brought into contact with the drive force transmission face 101*b*2 by forward rotation of the drive shaft 101 of (360/N+Δθ1+Δθ2+θ3)°. Accordingly, the rotational angle α can be set as in the following Expression (1).

$$\alpha^\circ \geq (360/N + \Delta\theta 1 + \Delta\theta 2 + \theta 3^\circ) \quad (1)$$

In a case where manufacturing error is sufficiently negligible, there is no need to take Δθ1 and Δθ2 into consideration, and in a case where θ3a≤0° and θ3b≤0° hold, there is no need to take θ3 into consideration. Accordingly, in such a case, the rotational angle α can be set as in the following Expression (2).

$$\alpha^\circ \geq 360/N^\circ \quad (2)$$

Figure 17:
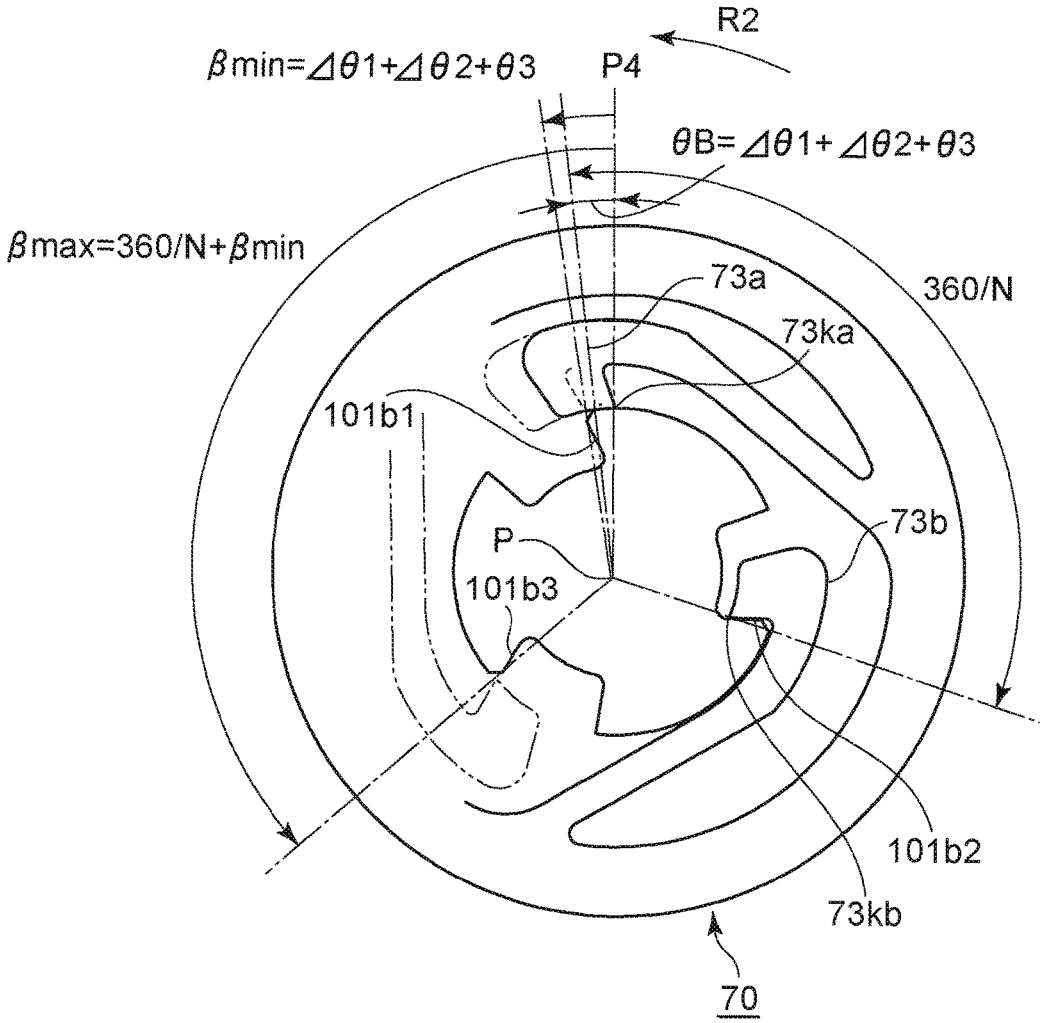
FIG. 17 is a cross-sectional view of the flange member and drive shaft, taken along a direction perpendicular to the rotation center (rotation axis line) of the drive shaft.

Next, the rotational angle β will be described with reference to FIG. 17. FIG. 17 is a cross-sectional view (X-Y cross-section) of the flange member 70 and drive shaft 101 taken along a plane perpendicular to the Z direction. The state drawn using solid lines in FIG. 17 represents a state in which an engaging portion 73*b* is engaging the drive force transmission face 101*b*2, and another engaging portion (first unengaged engaging portion 73*a*) is not engaging the second unengaged engaging portion (drive force transmission face) 101*b*1. A rotational phase P4 of a tip 73*ka* at this time is further upstream in an R2 direction than a position where a tip 73*kb* has rotated 360/N° from a rotational phase P5 in the R2 direction, by θB°. θB° can be expressed as θB=Δθ1+Δθ2+Δθ3. Performing backward rotation of the drive shaft 101 from here rotates the engaging portions 73 in the R2 direction. In order to move the tip 73*ka* further to the downstream side in the R2 direction than the second unengaged engaging portion (drive force transmission face)

101*b*1, rotation is performed in the R2 direction by at least βmin°. βmin° can be expressed as in the following Expression (3).

$$\beta\min^\circ=(\Delta\theta1+\Delta\theta2+\theta3a+\theta3b)^\circ=(\Delta\theta1+\Delta\theta2+\theta3)^\circ \quad (3)$$

βmin° is an angle indicating how far further downstream that a second unengaged engaging portion 101*b*1 at the upstream side of a first unengaged engaging portion 73*a* can move beyond that first unengaged engaging portion 73*a* in the backward rotation direction (arrow 140 direction) of the drive shaft 101. Further, an upper limit βmax° of the rotational angle β can be set within a range where the tip 73*ka* does not reach the downstream side in the R2 direction of a drive force transmission face 101*b*3. That is to say, βmax° is set as in the following Expression (4), $$\beta\max^\circ=\beta\min+360/N^\circ \quad (4)$$

so the rotational angle β is set as in the following Expressions (5) and (6).

$$\beta\min^\circ<\beta^\circ<\beta\max^\circ \quad (5)$$

$$(\Delta\theta1+\Delta\theta2+\theta3)^\circ<\beta^\circ<(\Delta\theta1+\Delta\theta2+\theta3+360/N)^\circ \quad (6)$$

In a case where manufacturing error is sufficiently negligible, there is no need to take Δθ1 and Δθ2 into consideration, and in a case where θ3a≤0° and θ3b≤0° hold, there is no need to take θ3 into consideration. Accordingly, in such a case, the rotational angle β can be set as in the following Expression (7).

$$0^\circ<\beta<360/N^\circ \quad (7)$$

The rotational angle β can also be set within a range where the engaging portions 73 of the coupling member 28 fit within the main body drive force transmission grooves 101*a* of the drive shaft 101, as illustrated in FIG. 16B. By satisfying this condition, drive force is not transmitted to the coupling member 28 when performing backward rotation of the drive shaft 101, so backward rotation of the main body drive shaft 101 does not involve rotation of the photosensitive drum unit 30, so the risk of damage can be reduced.

Figure 18:
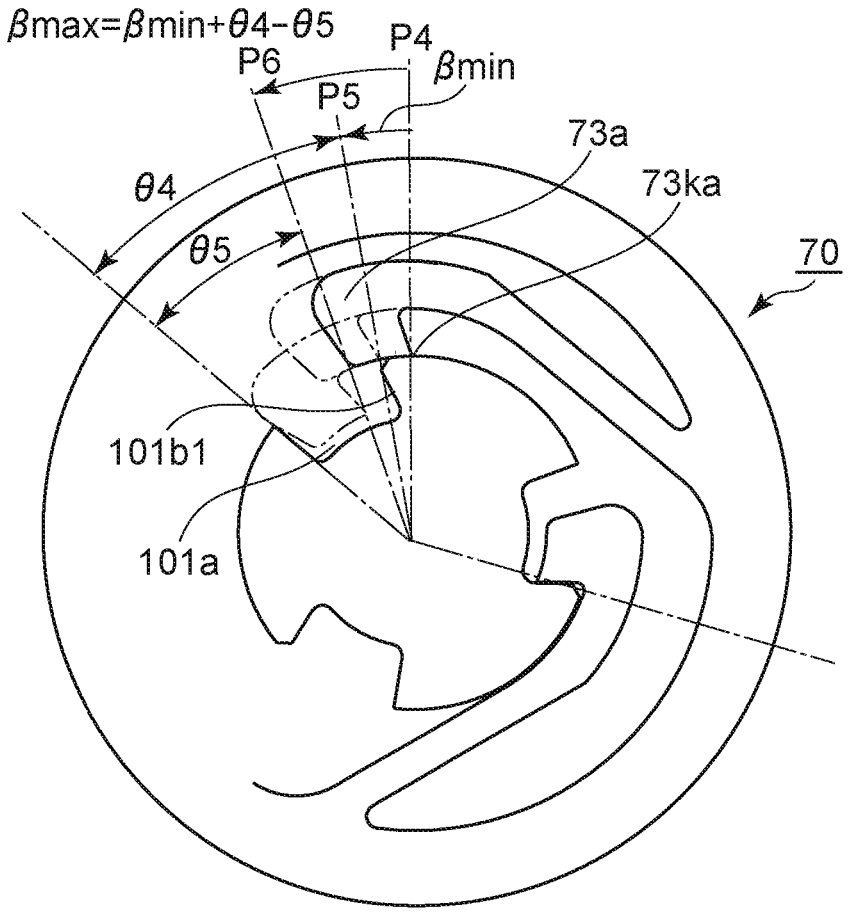
FIG. 18 is a cross-sectional view of the flange member and drive shaft, taken along a direction perpendicular to the rotation center (rotation axis line) of the drive shaft.

A configuration whereby the rotational angle β is set within a range where the engaging portions 73 of the coupling member 28 fit within the drive force transmission grooves 101*a* of the drive shaft 101 will be described with reference to FIG. 18. FIG. 18 is a cross-sectional view (X-Y cross-section) of each of the flange member 70 and drive shaft 101 taken along a plane perpendicular to the Z direction. The maximum value βmax of the rotational angle β can be set as in the following Expression (8)

$$\beta\max^\circ=(\beta\min+\theta4-\theta5)^\circ \quad (8)$$

where θ4 and θ5 represent the widths in the circumferential direction of the main body drive force transmission groove 101*a* and first unengaged engaging portion 73*a*, respectively.

As described earlier, when βmin°=0°, the rotational angle β can be set as in the following Expression (9)

$$0^\circ<\beta^\circ<(\theta4-\theta5^\circ) \quad (9)$$

where θ4>θ5 and (θ4−θ5)<(360/N) hold.

Also, the rotational speed when performing preparatory forward rotation is set to be lower than the rotational speed for normal image formation (when forming images on a recording material). A slower speed for engaging the main body drive force transmission faces 101*b* and engaging portions 73 enables damage to these parts to be reduced.

Also, the rotational speed when performing preparatory backward rotation is set to be lower than the rotational speed for normal image formation (when forming images on a recording material). A slower speed for backward rotation of the drive shaft 101 stabilizes operations, and the desired rotational angle is more readily achieved.

Timing for Performing Preparatory Operations

Next, the timing for performing preparatory operations will be described in detail. The image forming apparatus main body 100A is provided with a cartridge door (opening/closing member) 104 capable of opening/closing) the opening 120 for mounting/detaching the cartridges 7 (see FIG. 10). A detector 400 for detecting the open/closed state of the cartridge door 104 is also provided to the image forming apparatus main body 100A. The cartridge door 104 needs to be opened/closed for the user to mount a cartridge 7 to the image forming apparatus main body 100A.

Accordingly, the control unit 300 controls the motor so as to perform the above-described preparatory operations (preparatory forward rotation and preparatory backward rotation of the drive shaft 101), based on the detector 400 having detected the cartridge door 104 transitioning from an open state (open position) to a closed state (closed position). Accordingly, in a case of the user mounting a cartridge 7 to the image forming apparatus main body 100A, all engaging portions 73 and drive force transmission faces 101*b* can be engaged after the cartridge door 104 transitions to a closed state.

However, the detector 400 only functions in a state where electric power is being provided to the image forming apparatus main body 100A (so-called power-on state of the main body). That is to say, in a state where electric power is not being provided to the image forming apparatus main body 100A (so-called power-off state of the main body), the detector 400 cannot detect the open/closed state of the cartridge door 104. Accordingly, when the main body power source goes from off to an on state, the control unit 300 detects that the main body power source has gone from off to the on state. The motor is then controlled to execute the above-described preparatory operations (preparatory forward rotation and preparatory backward rotation of the drive shaft 101) as an initial operation, based on this detection. Accordingly, even if user has mounted a cartridge 7 to the image forming apparatus main body 100A while the main body power source is off, all engaging portions 73 and drive force transmission faces 101*b* can be engaged after the main body power source is turned on.

Restricting the timing of performing preparatory forward rotation and preparatory backward rotation in this way enables image formation to be performed in a state where all engaging portions 73 and drive force transmission faces 101*b* are engaged, even without performing preparatory operations every time before forming images. That is to say, the number of times of performing preparatory operations can be reduced as compared to a configuration where preparatory operations are performed before each image formation, and increased downtime due to performing preparatory operations can be suppressed.

According to the present embodiment, drive force transmission members and drive force receiving members can be engaged in a sure manner, so damage to the drive force transmission members and drive force receiving members can be suppressed.

Modification

Although the drive shaft 101 has been described in the above embodiment as having a configuration where drive force for rotating the photosensitive drum 1 is transmitted via the coupling member 28, the drive shaft 101 may also transmit drive force for rotating the developing roller 17 and charging roller 2 as well.

Although an arrangement has been described in the embodiment above where the drive shaft 101 is provided to the image forming apparatus main body 100A and the coupling member 28 is provided to the process cartridge 7, an arrangement may be made where the coupling member 28 is provided to the image forming apparatus main body 100A and the drive shaft 101 is provided to the process cartridge 7.

Second Embodiment

A second embodiment will be described next, with reference to FIGS. 19 through 27. An image forming apparatus 200 according to the present embodiment differs from the first embodiment in that the photosensitive drum 1 and a developing roller 217 are driven by separate drive shafts provided to an image forming apparatus main body 200A. Preparatory operations after mounting a cartridge in such a configuration will be described in the present embodiment. Parts that are the same as in the first embodiment will be referred to by the same names in the following description, and description thereof will be omitted.

Overview of Electrophotographic Image Forming Apparatus

Figure 19:
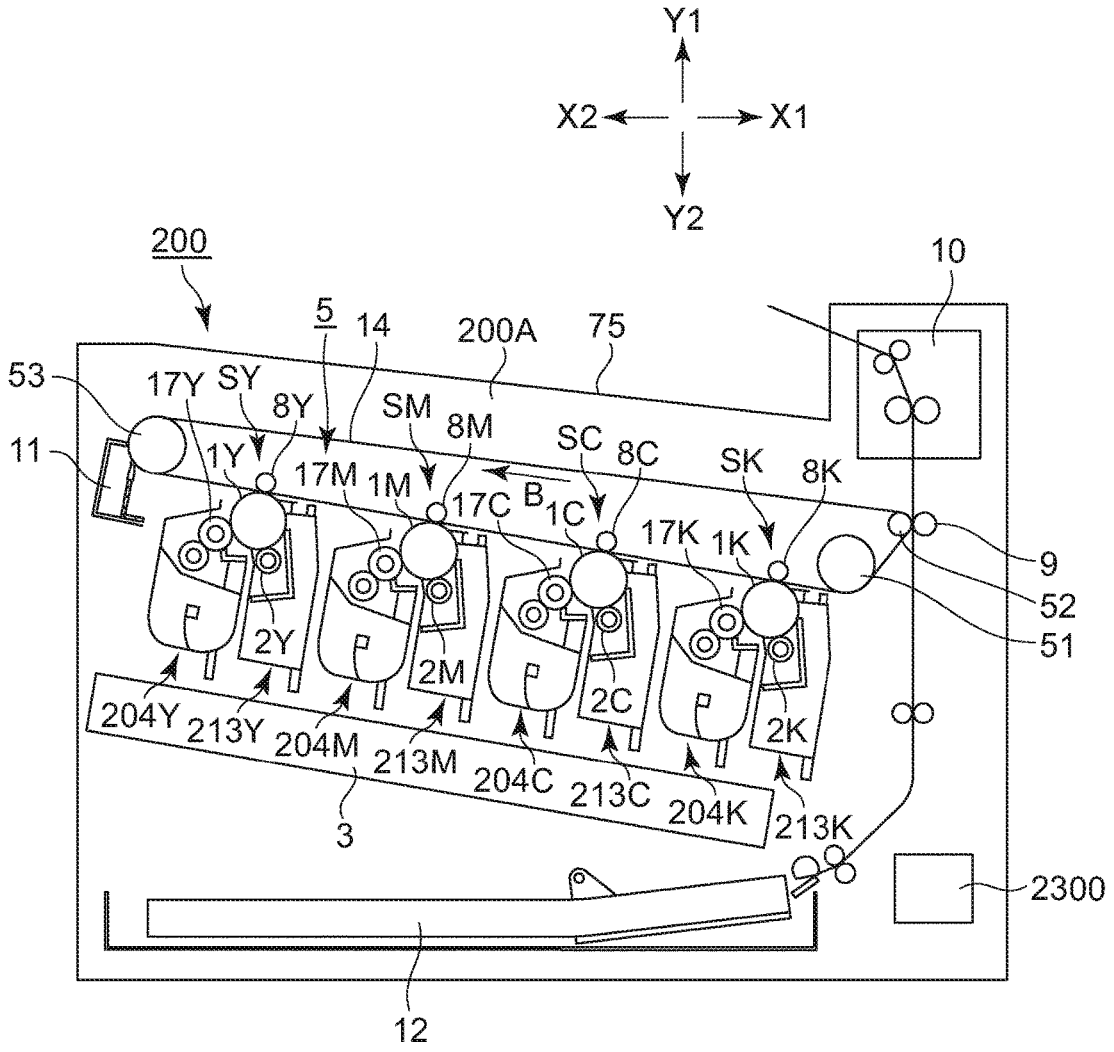
FIG. 19 is a schematic cross-sectional view of an image forming apparatus.

First, the overall configuration of the electrophotographic image forming apparatus (image forming apparatus) according to the present embodiment will be described with reference to FIG. 19. FIG. 19 is a schematic cross-sectional view of the image forming apparatus 200 according to the present embodiment. The image forming apparatus 200 has multiple image forming portions, which serve as first, second, third, and fourth image forming portions SY, SM, SC, and SK for forming images of the colors yellow (Y), magenta (M), cyan (C), and black (K), respectively. The first through fourth image forming portions SY, SM, SC, and SK in the present embodiment are arrayed in a single line, generally in the horizontal direction.

Note that in the present embodiment, the configurations and operations of the drum cartridges (first cartridge) 213 (213Y, 213M, 213C, and 213K) and developing cartridges (second cartridge) 204 (204Y, 204M, 204C, 204K) are substantially the same, except for the colors of formed images being different. Accordingly, in cases in the following description where there is no particular need to distinguish therebetween, the Y, M, C, and K will be omitted, a description will be made collectively.

In the present embodiment, the image forming apparatus 200 has four cylinders having photosensitive layers (photosensitive drum) 1, serving as multiple image bearing members, that are arrayed in a direction slightly inclined toward the vertical direction. The scanner unit (exposing device) 3 is provided at the lower side of the drum cartridge 213 and developing cartridge 204 in the gravitational direction. Provided in the vicinity of the photosensitive drum 1 is the charging roller 2 and so forth, serving as a process arrangement (process device, process member) that acts upon the photosensitive drum 1.

The charging roller 2 is a charging arrangement (charging device, charging member) that uniformly charges the surface of the photosensitive drum 1. The scanner unit (exposing device) 3 is an exposing arrangement (exposing device, exposing member) that forms an electrostatic image (electrostatic latent image) on the photosensitive drum 1 by irradiation by laser, based on image information. Provided in the vicinity of the photosensitive drum 1 is the cleaning blade 6 serving as a cleaning arrangement (cleaning device, cleaning member), and the developing cartridge 204.

Note that the drum cartridges 213 and developing cartridges 204 are independently mountable to and detachable from the image forming apparatus main body 200A. That is to say, in a state where any or all of the drum cartridges 213 are mounted to the image forming apparatus main body 200A, any or all of the developing cartridges 204 can be mounted to or detached from the image forming apparatus main body 200A. Also, in a state where any or all of the developing cartridges 204 are mounted to the image forming apparatus main body 200A, any or all of the drum cartridges 213 can be mounted to or detached from the image forming apparatus main body 200A.

Further, the intermediate transfer belt 5 serving as an intermediate transfer member to transfer a toner image on the photosensitive drum 1 onto the recording material (sheet, recording medium) 12 is disposed facing the four photosensitive drums 1. The developing cartridge 204 according to the present embodiment uses a nonmagnetic one-component developing agent (hereinafter, "toner") as a developing agent, and employs contact developing, where a developing roller 217 serving as a developing agent bearing member is brought into contact with the photosensitive drum 1.

In the above-described configuration, a toner image formed on the photosensitive drum 1 is transferred onto a sheet (paper) 12, and the toner image transferred into the sheet is fixed. The drum cartridge 213 includes the charging roller 2 that charges the photosensitive drum 1, and the cleaning blade 6 that cleans untransferred residual toner off of the photosensitive drum 1, as process arrangements that act upon the photosensitive drum 1. The transfer residual toner remaining on the photosensitive drum 1 without being transferred into the sheet 12 is recovered by the cleaning blade 6. The transfer residual toner recovered by the cleaning blade 6 is stored in a removed developing agent storage unit (hereinafter, "waste toner storage unit") 214*a* via an opening 214*b*. The waste toner storage unit 214*a* and cleaning blade 6 are integrated, and make up the drum cartridge 213.

The image forming apparatus main body 200A has guides (positioning arrangements) such as mounting guides, positioning members (omitted from illustration), and so forth. The configuration is such that the developing cartridge 204 and drum cartridge 213 are guided by the aforementioned guides, and detachably mounted to the apparatus main body 200A. The toners of the colors yellow (Y), magenta (M), cyan (C), and black (K), are stored in the developing cartridge 204 of the respective colors.

The intermediate transfer belt 5 rotates (moves) in the direction of the arrow B in FIG. 1, in contact with the photosensitive drums 1 that the drum cartridges 213 have. The intermediate transfer belt 5 runs around multiple supporting members (driving roller 51, secondary-transfer opposing roller 52, slave roller 53). Four primary transfer rollers 8 serving as a primary transfer arrangement are arrayed on the inner peripheral face side of the intermediate transfer belt 5, facing the photosensitive drums 1. A secondary transfer roller 9 serving as a secondary transfer arrangement is disposed at a position facing the secondary-transfer opposing roller 52 at the outer peripheral face side of the intermediate transfer belt 5.

Next, an image forming method will be described with reference to FIG. 19. First, the surface of the photosensitive drum 1 is uniformly charged by bias being applied from a charging bias power source (omitted from illustration) within the image forming apparatus main body to the charging roller 2. Scanning exposure of the surface of the charged photosensitive drum 1 is then performed by laser beams corresponding to image information, emitted from the scanner unit 3. Accordingly, an electrostatic latent image corresponding to the image information is formed on the photosensitive drum 1. The electrostatic latent image formed on the photosensitive drum 1 is developed as a toner image by the developing cartridge 204. The toner image formed on the photosensitive drum 1 is transferred (primary transfer) onto the intermediate transfer belt 5 by operation of the primary transfer roller 8.

For example, when forming a full-color image, the above-described process is sequentially performed at the four drum cartridges 213 (213Y, 213M, 213C, 213K) and developing cartridges 204 (204Y, 204M, 204C, 204K). The toner images of the respective colors, which have been formed on the photosensitive drums 1 of the drum cartridges 213, are subjected to primary transfer onto the intermediate transfer belt 5, so as to be overlaid. Thereafter, the recording material 12 is transferred to a secondary transfer portion in synch with moment of the intermediate transfer belt 5. The four-color toner image on the intermediate transfer belt 5 is then transferred together onto the recording material 12 conveyed to the secondary transfer portion formed by the intermediate transfer belt 5 and secondary transfer roller 9.

The recording material 12 onto which the toner image has been transferred is conveyed to a fixing device 10 that serves as a fixing arrangement. The recording material 12 is subjected to heat and pressure at the fixing device 10, thereby fixing the toner image onto the recording material 12. Primary-transfer residual toner remaining on the photosensitive drum 1 after the primary transfer process is removed by the cleaning blade 6 and collected as waste toner. The secondary-transfer residual toner remaining on the intermediate transfer belt 5 after the secondary transfer process is removed by a belt cleaning device 11. Note that the image forming apparatus 200 is also arranged to be able to form monochrome or multi-color images using a desired one or some (not all) image forming portions.

Overall Configuration of Drum Cartridge and Developing Cartridge

Figure 20:
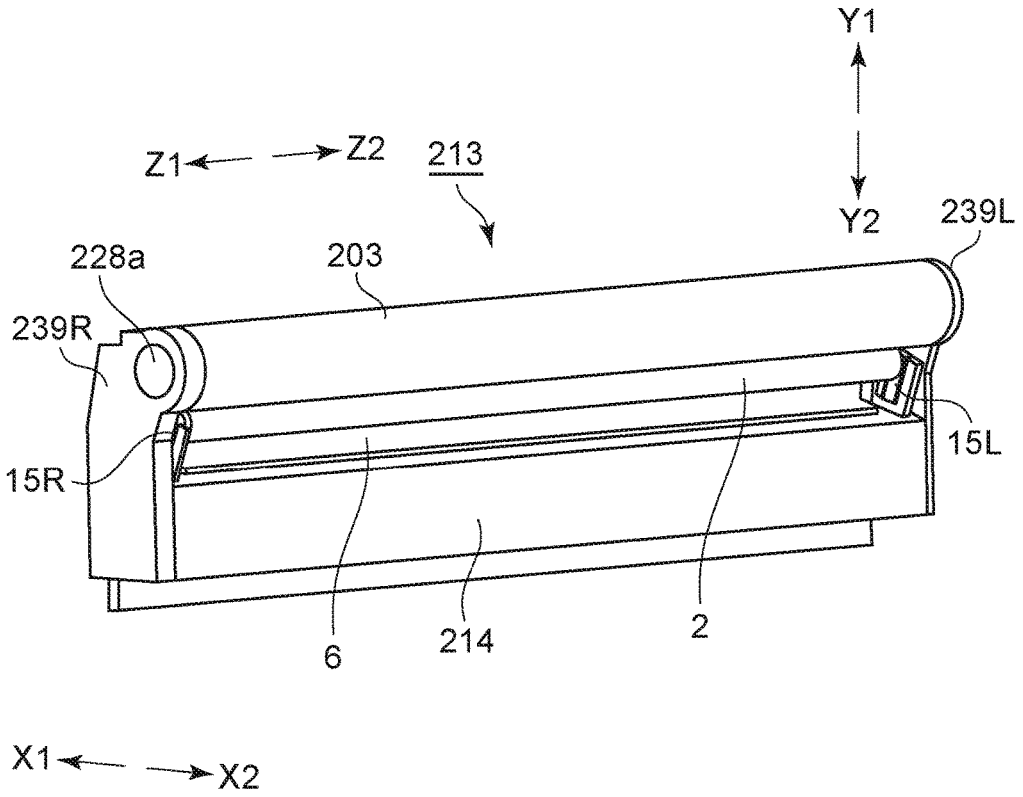
FIG. 20 is an external perspective view of a drum cartridge.
Figure 21:
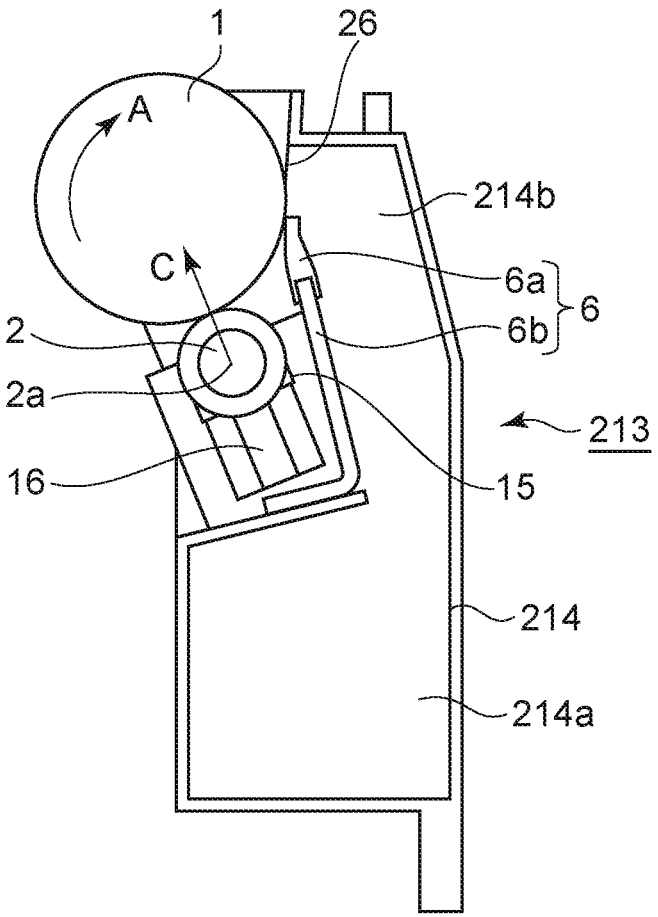
FIG. 21 is a cross-sectional view of the drum cartridge.
Figure 22:
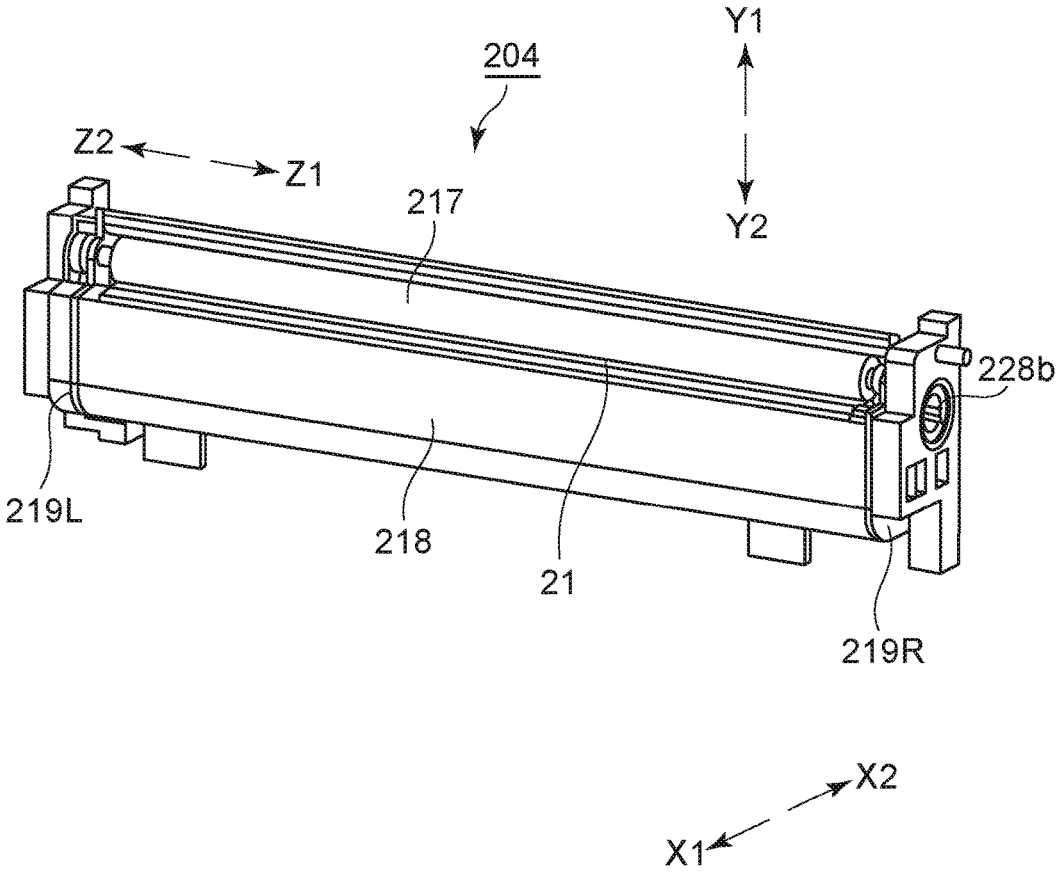
FIG. 22 is an external perspective view of a developing cartridge.
Figure 23:
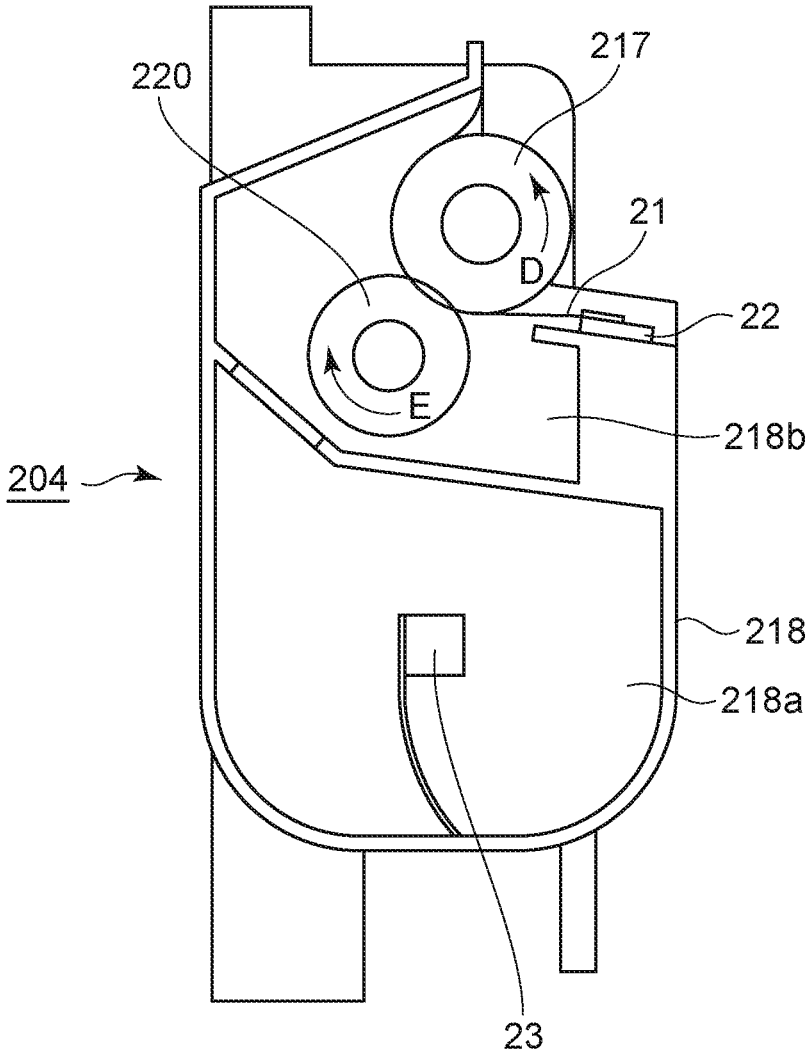
FIG. 23 is a cross-sectional view of the developing cartridge.
Figure 24:
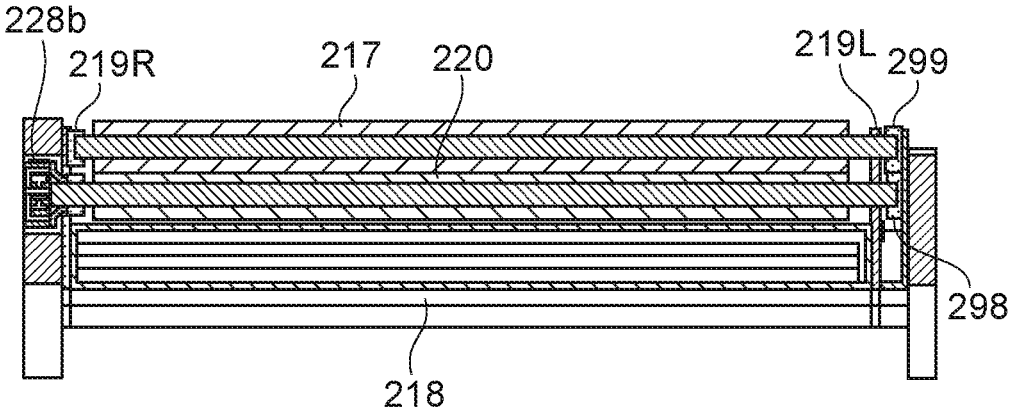
FIG. 24 is a cross-sectional view illustrating a driving configuration of the developing cartridge.

The overall configuration of the drum cartridges 213 (213Y, 213M, 213C, 213K) and developing cartridges 204 (204Y, 204M, 204C, 204K) mounted to the image forming apparatus main body 200A illustrated in FIG. 19 will be described with reference to FIGS. 20 through 24. FIG. 19 is a schematic cross-sectional view of the image forming apparatus 200. FIG. 20 is an external perspective view of the drum cartridge 213. FIG. 21 is a cross-sectional view of the drum cartridge 213. FIG. 22 is an external perspective view of the developing cartridge 204. FIG. 23 is a cross-sectional view of the developing cartridge 204. FIG. 24 is a cross-sectional view illustrating a driving configuration of the developing cartridge 204, the cross-section thereof being parallel to an axis line of the developing roller 217.

Note that the drum cartridge 213Y, the drum cartridge 213M, the drum cartridge 213C, and the drum cartridge 213K, have the same configuration. Also, the developing cartridge 204Y, the developing cartridge 204M, the developing cartridge 204C, and the developing cartridge 204K have the same configuration, except for the point that the colors of the toners stored therein are different. The developing cartridge 204Y stores yellow toner, the developing cartridge 204M stores magenta toner, the developing cartridge 204C stores cyan toner, and the developing cartridge 204K stores black toner. Accordingly, the drum cartridges 213Y, 213M, 213C, and 213K will be collectively referred to as "drum cartridge 213" in the following description, and the developing cartridges 204Y, 204M, 204C, and 204K will be collectively referred to as "developing cartridge 204". Other components of the cartridges will also be referred to collectively in the same way.

FIG. 20 is an external perspective view of the drum cartridge 213. As illustrated in FIG. 20, the rotation axis direction of the photosensitive drum 1 is the Z direction (arrows Z1 and Z2), a horizontal direction in FIG. 19 is the X direction (arrows X1 and X2), and a vertical direction in FIG. 19 is the Y direction (arrows Y1 and Y2).

Both ends of the photosensitive drum 1 are rotatably supported by drum unit bearing members 239R and 239L. A first coupling member 228*a* is attached to a drive side end of the photosensitive drum 1 as a flange, and rotates integrally with the photosensitive drum 1. The drum unit bearing members 239R and 239L are attached to both sides of the cleaning frame 214, each supporting a photosensitive drum unit 203. Accordingly, the photosensitive drum unit 203 is rotatably supported by the cleaning frame 214.

The charging roller 2 and cleaning blade 6 are also attached to the cleaning frame 214, and are disposed so as to come into contact with the surface of the photosensitive drum 1. Charging roller bearings 15 are also attached to the cleaning frame 214. The charging roller bearings 15 are bearing for supporting the shaft of the charging roller 2.

Now, the charging roller bearings 15 are attached so as to be capable of moving in the direction of arrow C in FIG. 21. A rotating shaft 2*a* of the charging roller 2 is rotatably attached to the charging roller bearings 15. The charging roller bearings 15 are urged toward the photosensitive drum 1 by a pressing spring 16 serving as an urging arrangement. Accordingly, the charging roller 2 comes into contact with the photosensitive drum 1, and the photosensitive drum 1 rotates, being driven thereby.

The cleaning frame 214 is provided with the cleaning blade 6 serving as a cleaning arrangement to remove toner remaining on the surface of the photosensitive drum 1. The cleaning blade 6 has a blade-shaped rubber member (elastic member) 6*a* that removes toner on the photosensitive drum 1 by coming into contact with the photosensitive drum 1, and a supporting plate 6*b* that supports the blade-shaped rubber member 6*a*, that have been integrated. The supporting plate 6*b* is fixed to the cleaning frame 214 by screws in the present embodiment.

The cleaning frame 214 has the opening 214*b* to recover transfer residual toner recovered by the cleaning blade 6, as described earlier. The opening 214*b* has a blowout prevention sheet 26 that seals between the photosensitive drum 1 and the opening 214*b*, thereby preventing leakage of toner in the upwards direction of the opening 214*b*.

FIG. 22 is an external perspective view of the developing cartridge 204. The developing cartridge 204 has a developing frame 218 that supports various types of components. The developing cartridge 204 is provided with the developing roller 217 serving as a developing agent bearing member that rotates in the direction of the arrow D in FIG. 23 (counterclockwise direction) while in contact with the photosensitive drum 1. The developing roller 217 is rotatably supported at both ends thereof in the longitudinal direction (rotation axis direction) by developing bearings 219 (219R, 219L). The developing bearings 219 (219R, 219L) are attached to both side portions of the developing frame 218.

The developing cartridge 204 also has a developing agent storage chamber (hereinafter, "toner storage chamber") 218*a* and a developing chamber 218*b* where the developing roller 217 is disposed, as illustrated in FIG. 23. Also disposed in the developing chamber 218*b* are a toner supply roller 220 serving as a developing agent supply member that rotates in the direction of the arrow E while in contact with the developing roller 217, and a developing blade 21 serving as a developing agent regulating member that regulates a toner layer on the developing roller 217. Both ends of the toner supply roller 220 are rotatably supported by the developing frame 218. The second coupling member 228*a* is fixed to the end of the core (shaft) of the toner supply roller 220, and rotates integrally with the toner supply roller 220. The developing blade 21 is fixed to and integrated with a fixing member 22 by welding or the like. Disposed in the toner storage chamber 218*a* of the developing frame 218 is the agitating member 23 that agitates toner stored in the toner storage chamber 218*a*, and conveys the toner to the toner supply roller 220.

Configuration of Main Body Drive Shaft and Coupling Member

Figure 28:
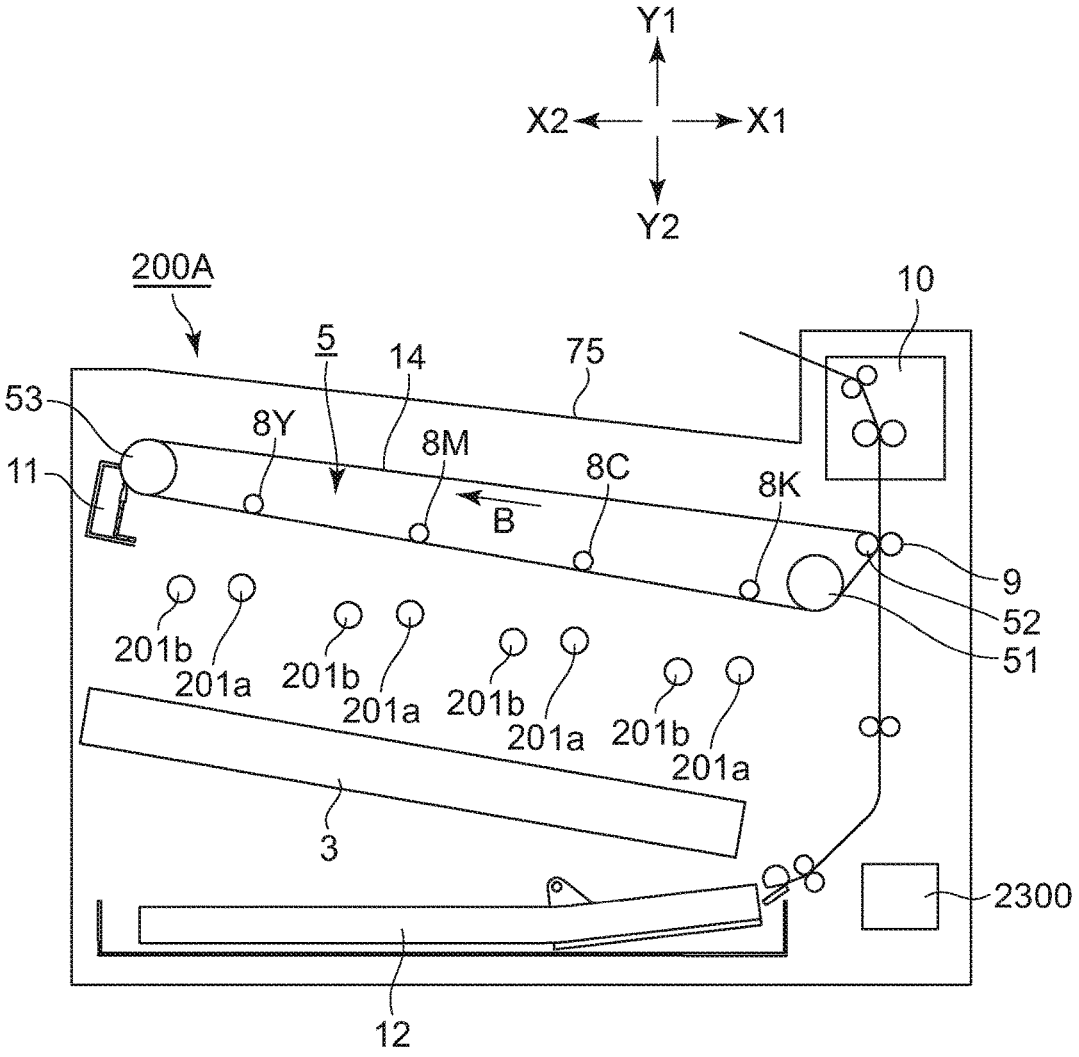
FIG. 28 is a schematic cross-sectional view of an apparatus main body.

A configuration for transmitting drive force from the image forming apparatus main body 200A to the cartridges will be described with reference to FIG. 28. FIG. 28 is a schematic cross-sectional view of the image forming apparatus main body 200A, to which the drum cartridges 213 and developing cartridges 204 have not been mounted. The image forming apparatus main body 200A has four first drive shafts (first drive force transmission member) 201*a* that engage the first coupling members (first driving force receiving member) 228*a* of the drum cartridges 213. The image forming apparatus main body 200A also has four second drive shafts (second drive force transmission member) 201*b* that engage the second coupling members (second driving force receiving member) 228*b* of the developing cartridges 204. The first drive shaft 201*a* and second drive shaft 201*b* are of the same configuration as the drive shaft 101 in the first embodiment. That is to say, there are three drive force transmission faces. Also, the first coupling member 228*a* and second coupling member 228*b* are the same as the coupling member 28 in the first embodiment. That is to say, N1=3 and N2=3, where N1 is the number of engaging portions of the first coupling member 228*a* and N2 is the number of engaging portions of the second coupling member 228*b*.

The first drive shaft 201*a* and second drive shaft 201*b* are respectively driven by an unshown first motor and second motor. A control unit 2300 controls the first motor and second motor, thereby controlling the rotations of the first drive shaft 201*a* and second drive shaft 201*b*.

Driving of Developing Roller

In a state where the second coupling member 228*b* has engaged the second drive shaft 201*b* as illustrated in FIG. 24, when the second drive shaft 201*b* rotates the drive force is transmitted and the second coupling member 228*b* rotates. The drive force is transmitted from the second coupling member 228*b* to the shaft of the toner supply roller 220, thereby rotating the toner supply roller 220. Rotation of the toner supply roller 220 causes a toner supply roller gear 298 fixed to the end of the shaft of the toner supply roller 220 in the Z1 direction to rotate. This transmits the drive force to a developing roller gear 299 that is fixed to the end of the shaft of the developing roller 217 in the Z1 direction and that meshes with the toner supply roller gear 298, thereby rotating the developing roller 217.

Process of Mounting Drum Cartridge and Developing Cartridge

The process of mounting each of the developing cartridge 204 and drum cartridge 213 to the apparatus main body 200A is the same as the process of mounting the process cartridge 7 according to the first embodiment to the apparatus main body 100A.

Contact/Separation Mechanism for Drum and Developing Roller

Figure 25:
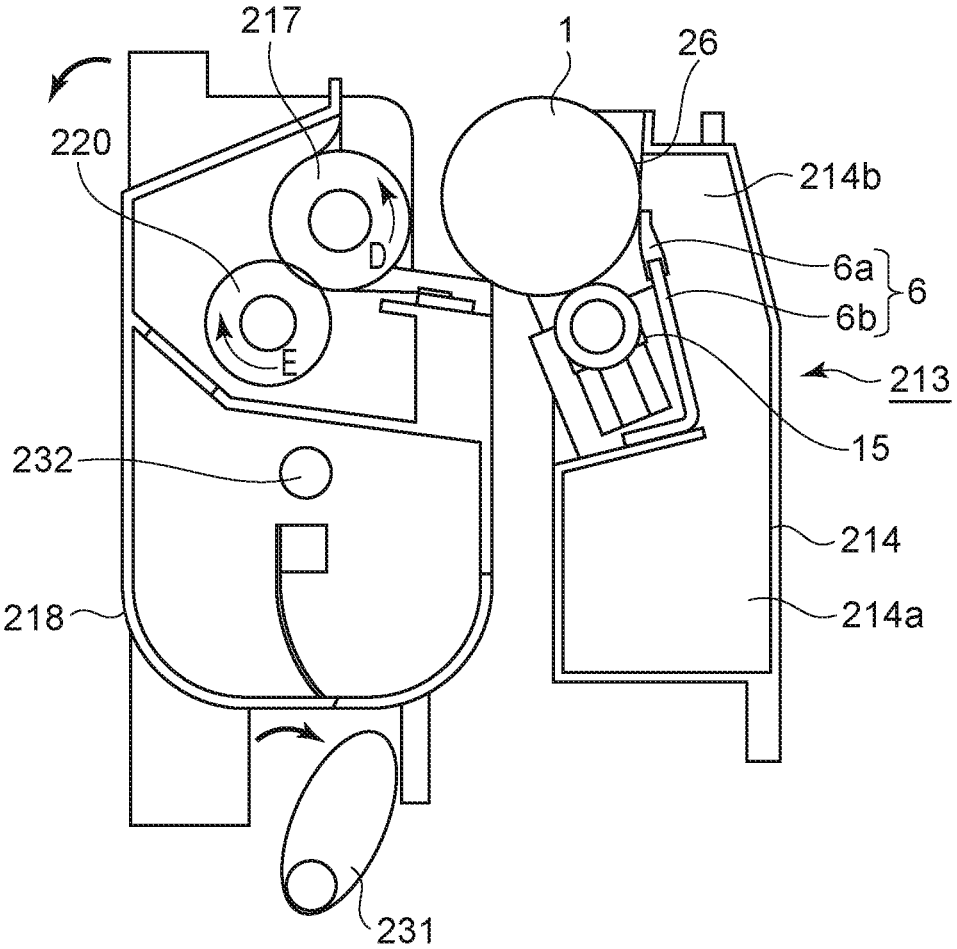
FIG. 25 is a diagram illustrating a separated state of the drum cartridge and developing cartridge.

FIG. 25 is a cross-sectional view of the developing cartridge 204 and drum cartridge 213 in a state of having been positioned within the image forming apparatus main body 200A. The photosensitive drum 1 and developing roller 217 are in a separated state. The image forming apparatus 200 according to the present embodiment is configured such that the developing roller 217 can transition from this state to a state of being in contact with the photosensitive drum 1.

Figure 26:
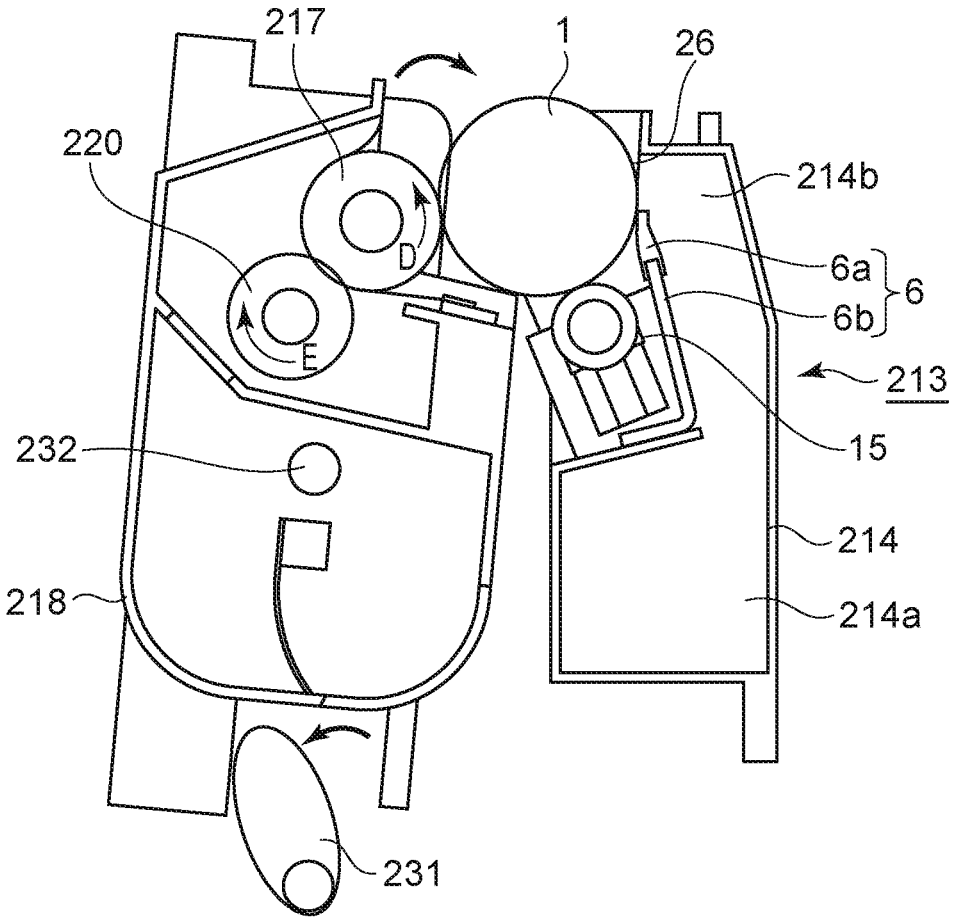
FIG. 26 is a diagram illustrating a contact state of the drum cartridge and developing cartridge.

Specifically, rotation of a cam 231 provided to the apparatus main body 200A is controlled to press the developing frame 218, thereby pivoting the developing frame 218 centered on a rotation center 232. In order to realize a separated state where the developing roller 217 is separated from the photosensitive drum 1 as illustrated in FIG. 25, the cam 231 is rotated in the clockwise direction in FIG. 25 to urge the base portion of the developing frame 218 toward the right side, and is maintained in this state. In order to realize a contact state where the developing roller 217 is in contact with the photosensitive drum 1 as illustrated in FIG. 26, the cam 231 is rotated in the counterclockwise direction in FIG. 26 to urge the base portion of the developing frame 218 toward the left side, and is maintained in this state. Rotational control of the cam 231 is effected by the control unit 2300.

The image forming apparatus 200 is configured such that the second drive shaft 201*b* can be rotated only when in the contact state, and is configured such that the second drive shaft 201*b* cannot be rotated when in the separated state. According to this configuration, the developing roller 217 and toner supply roller 220 rotate only when in the contact state, and do not rotate in the separated state. Accordingly, the rotation time of the developing roller 217 and toner supply roller 220 can be maximally reduced, and reduction in durability of the developing roller 217 and toner supply roller 220, and of toner stored within the developing frame 218, can be suppressed.

Preparatory Operations

Figure 27:
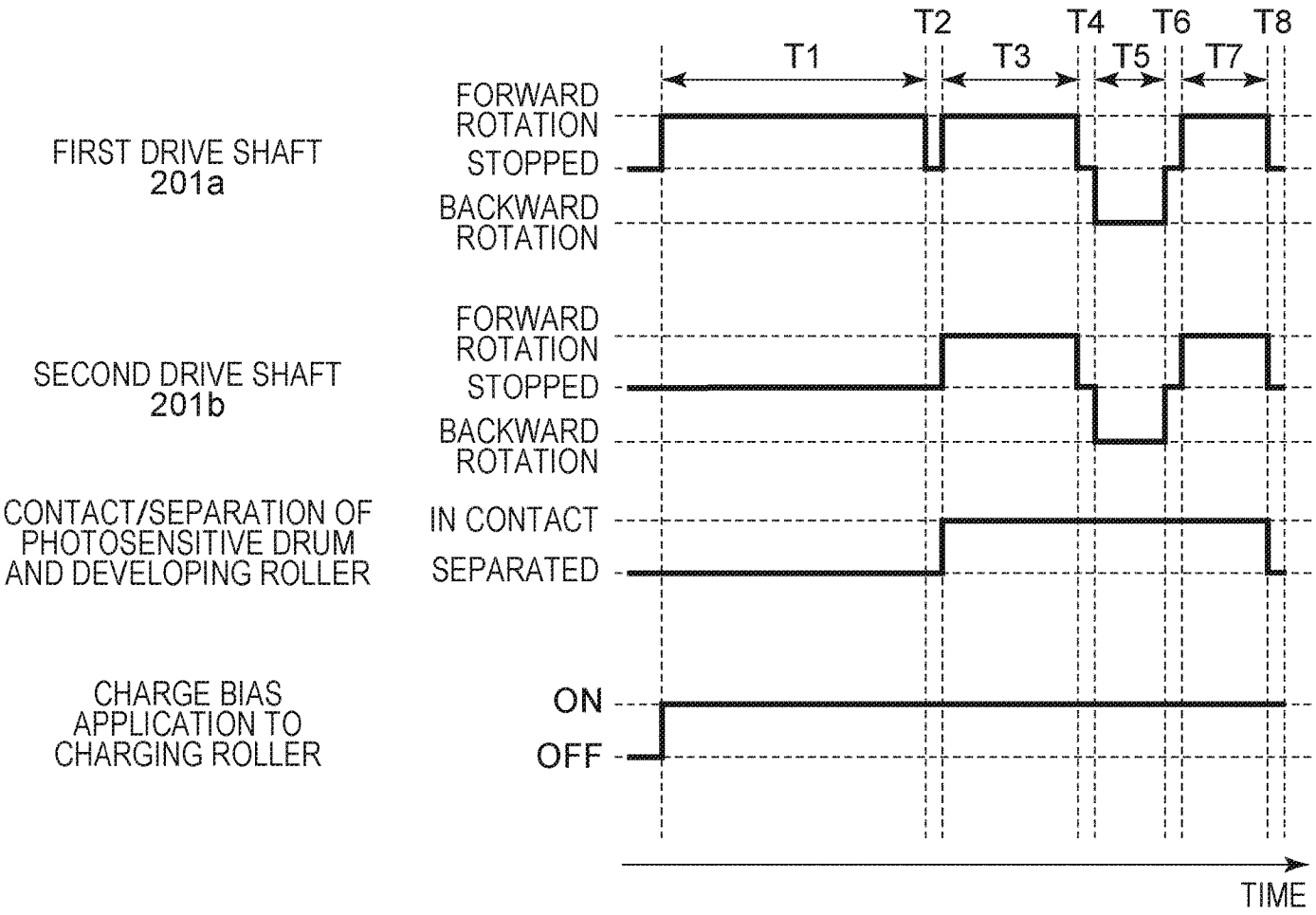
FIG. 27 is a sequence diagram illustrating poor-engagement control operations.

Preparatory operations after mounting cartridges will be described with reference to FIG. 27. Preparatory operations are to execute an operation where preparatory forward rotation (a first forward rotation step) and preparatory backward rotation (a first backward rotation step) of the first drive shaft 201*a* is performed so as to engage with the first coupling member 228*a*, and an operation where preparatory forward rotation (a second forward rotation step) and preparatory backward rotation (a second backward rotation step) of the second drive shaft 201*b* is performed so as to engage with the second coupling member 228*b*. Now, the configuration is such that the second drive shaft 201*b* only rotates when in contact, as described above, so the developing roller 217 is in contact with the photosensitive drum 1 when performing preparatory forward rotation. However, depending on the potential of the photosensitive drum 1 at this time, toner borne on the surface of the developing roller 217 may adhere to the photosensitive drum 1 (fogging). If toner that has adhered to the photosensitive drum 1 is transferred to the intermediate transfer belt 5 and adheres to the secondary transfer roller 9, and is transferred to the rear face of the recording material 12 conveyed to the secondary transfer portion, the recording material 12 will be contaminated. Accordingly, preparatory operations are performed in the present embodiment where adhesion of toner borne on the surface of the developing roller 217 to the photosensitive drum 1 is suppressed. The preparatory operations will be described in periods T1 through T8.

Period T1 is a period in which toner fogging does not occur even in a case where the developing roller 217 is in contact with the photosensitive drum 1 while performing preparatory forward rotation of the first drive shaft 201*a*. The control unit 2300 controls application of voltage (charging bias) to the charging roller 2. Specifically, voltage of approximately −1000 V (charging bias) is applied to the charging roller 2 while performing forward rotation of the first drive shaft 201*a* by an angle γ. Accordingly, the region of the surface of the photosensitive drum 1 that comes into contact with the charging roller 2 is charged to approximately −450 V. Although γ°=223° in the present embodiment, the angle γ is an angle where a region of the surface of the photosensitive drum 1 charged by the charging roller 2 reaches a position of coming into contact with the developing roller 217. An angle where at least one of the three engaging portions of the first coupling member 228*a* engages a driving force transmission face of the first drive shaft 201*a* is 120° (i.e., 360/N1°). A rotational angle θ6 from a position where a predetermined point on the photosensitive drum 1 comes into contact with the charging roller 2 to a position coming into contact with the developing roller 217 is 102°. Accordingly, γ° is expressed by the following Expression (10).

$$\gamma^\circ \geq (360/N1+\theta 6)^\circ = 120^\circ + 102^\circ = 222^\circ \quad (10)$$

Accordingly, in period T1, the first drive shaft 201*a* is rotated by angle γ, and the photosensitive drum 1 can be rotated by 102° or more in a sure manner. Since γ° is an angle where at least one of the engaging portions of the first coupling member 228*a* engages the first drive shaft 201*a*, this also corresponds to α° in the first embodiment (α1). Although there is a possibility in this period T1 that the photosensitive drum 1 is being rotated with only one engaging portion engaged, there is no problem because this is for a short period. Also, the photosensitive drum 1 and developing roller 217 are in a separated state and the second drive shaft 201*b* is stopped in period T1.

Period T2 is a standby period until the next operation. The first drive shaft 201*a* is in a stopped state. The stopped state is 0.1 seconds in the present embodiment. The second drive shaft 201*b* also is stopped at this time. The photosensitive drum 1 is in a separated state from the developing roller 217, and charging bias is applied to the charging roller 2.

Period T3 is a period where, at least one of the three engaging portions of the second coupling member 228*b* is engaged with a driving force transmission face of the second drive shaft 201*b*. The photosensitive drum 1 and the developing roller 217 are in contact in this period T3, and charging bias is applied to the charging roller 2. Also, approximately −300 V of voltage (developing bias) is applied to the developing roller 217. The toner has negative charging polarity, and the region of the surface of the photosensitive drum 1 in contact with the charging roller 2 is charged to approximately −450 V by charging bias in period T1, so adhesion (fogging) of toner from the developing roller 217 onto the photosensitive drum 1 is suppressed. That is to say, this period T3 is a period for preparatory forward rotation of the first drive shaft 201*a* and second drive shaft 201*b*. The first drive shaft 201*a* and second drive shaft 201*b* are rotated at the same time in this period T3. The reason is that the photosensitive drum 1 needs to be in contact with the developing roller 217 in order for the second drive shaft 201*b* to be rotated in the present embodiment. In a case where the developing roller 217 rotates with the photosensitive drum 1 remaining stopped, drum rubbing memory and scattering of toner may occur.

This "rubbing memory" is an electrical memory phenomenon that occurs due to just part of the photosensitive drum 1 in the circumferential direction being rubbed by the developing roller 217. Uniform charging by the charging roller 2 cannot be performed at portions where electric memory has occurred, so a horizontal black stripe occurs in a halftone image every cycle of the photosensitive drum 1. Scattering of toner is a phenomenon that occurs when the photosensitive drum 1 and the developing roller 217 are in contact, and the photosensitive drum 1 is stopped while just the developing roller 217 is rotating. That is to say, this is a phenomenon where toner borne on the surface of the developing roller 217 is dammed up and accumulates right before the contact position with the photosensitive drum 1, and eventually becomes scattered.

In order to prevent these phenomena, forward rotation of the first drive shaft 201*a* and second drive shaft 201*b* is performed at the same time, and the photosensitive drum 1 and developing roller 217 are rotated at the same time. In the present embodiment, the second drive shaft 201*b* is rotated by 143° corresponding to α° in the first embodiment, as the preparatory forward rotation (second forward rotation step) (α2°). Accordingly, the second drive shaft 201*b* rotates (360/N2)° or more, so at least one of the three engaging portions of the second coupling member 228*b* engages the second drive shaft 201*b*. The first drive shaft 201*a* also rotates 57° as preparatory forward rotation (first forward rotation step), while the second drive shaft 201*b* rotates 143°. This rotational angle is decided by the gear ratio between the first drive shaft 201*a* and second drive shaft 201*b*.

Period T4 is a standby period until the next operation. The first drive shaft 201*a* and second drive shaft 201*b* are in a stopped state. The stopped state is 0.1 seconds in the present embodiment. The photosensitive drum 1 and the developing roller 217 are in a contact state, and charging bias is applied to the charging roller 2.

Period T5 is a period where preparatory backward rotation of the first drive shaft 201*a* and second drive shaft 201*b* is performed. The first drive shaft 201*a* and second drive shaft 201*b* perform backward rotation at the same time. In the present embodiment, backward rotation of the first drive shaft 201*a* is performed by 11° as preparatory backward rotation (first backward rotation step), and backward rotation of the second drive shaft 201*b* is performed by 33° as preparatory backward rotation (second backward rotation step). This angle is an angle by which a state where an engaging portion has ridden up can be resolved in a sure manner as described in the first embodiment, taking into consideration the manufacturing tolerance of the first drive shaft 201*a*, second drive shaft 201*b*, first coupling member 228*a*, and second coupling member 228*b*, and corresponds to β°. That is to say, β (β1)°>(360/N1°) is set for the first drive shaft 201*a*, and β (β2)°>(360/N2°) is set for the second drive shaft 201*b*. Note that the first drive shaft 201*a* and second drive shaft 201*b* are performing backward rotation in period T5, and accordingly are not engaged with the respective first coupling member 228*a* and second coupling member 228*b*, with the photosensitive drum 1 and developing roller 217 each being in a stopped state. Thus, there is no occurrence of rubbing memory or scattering of toner in period T5. The photosensitive drum 1 and developing roller 217 are in a contact state in period T5, with charging bias being applied to the charging roller 2.

Period T6 is a standby period until the next operation. The first drive shaft 201*a* and second drive shaft 201*b* are in a stopped state. The stopped state is 0.5 seconds in the present embodiment. The reason that the standby time is longer than in periods T2 and T4 is in order to stop rotation in a sure manner, since stopping from the backward rotation operations in period T5 is harder to stabilize as compared to stopping from forward rotation operations. The photosensitive drum 1 and the developing roller 217 are in a contact state, and charging bias is applied to the charging roller 2. At this time, each of the multiple (three) drive force transmission faces of the first drive shaft 201*a* is situated further upstream, in relation to the forward rotation direction of the first drive shaft 201*a*, from the engaging portion out of the multiple (three) engaging portions of the first coupling member 228*a* with which engaging will be realized in the end. Further, each of the multiple (three) drive force transmission faces of the second drive shaft 201*b* is situated further upstream, in relation to the forward rotation direction of the second drive shaft 201*b*, from the engaging portion out of the multiple (three) engaging portions of the second coupling member 228*b* with which engaging will be realized in the end.

Period T7 is a period in which all engaging portions of the first coupling member 228*a* and second coupling member 228*b* are engaged with the first drive shaft 201*a* and second drive shaft 201*b*. Accordingly, rotation of an angle equal to or greater than that of the backward rotation in period T5 needs to be performed. The first drive shaft 201*a* and second drive shaft 201*b* also need to be rotated at the same time, so the developing roller 217 is not rotated while the photosensitive drum 1 is in a stopped state, the same as in period T3. The first drive shaft 201*a* is rotated forward by 13° and the second drive shaft 201*b* by 430 in the present embodiment. The photosensitive drum 1 and the developing roller 217 are in a contact state in period T7, and charging bias is applied to the charging roller 2.

Period T8 is the last period of the preparatory operations. The first drive shaft 201*a* and second drive shaft 201*b* are in a stopped state. An operation is performed to bring the photosensitive drum 1 and developing roller 217 to a separated state. The stopped state in period T8 is 0.5 seconds in the present embodiment. Charging bias is applied to the charging roller 2.

Thus, according to the preparatory operations made up of periods T1 through T8, the first drive shaft 201*a* and first coupling member 228*a*, and the second drive shaft 201*b* and second coupling member 228*b*, can be engaged in a sure manner, while suppressing toner borne on the surface of the developing roller 217 from adhering to the photosensitive drum 1. There also is no rotation of the developing roller 217 while the photosensitive drum 1 is stopped during preparatory operations, so defective images due to drum rubbing memory and scattering of toner can be prevented.

The speed at which the main body drive shafts are rotated in the present embodiment is ⅓ that of the speed when forming images, in the same way as in the first embodiment, but this is not restrictive. If there is another speed at which driving operations are more stable, in accordance with motor performance, that speed may be used. Also, the rotation speed ratio between the photosensitive drum 1 and toner supply roller 220 is the same ratio as when forming images, but this is not restrictive. For example, the speed of the toner supply roller 220 may be slower than when forming images, in order to prevent reduction in durability of the developing cartridge 204, for example.

Also, temporary stop periods have been provided at periods T2, T4, T6, and T8 in the present embodiment, but the specified times are not restricted to those described in the present embodiment. The application times may be changed in accordance with the operations of the first and second drive shafts 201*a* and 201*b*, or alternatively, the first and second drive shafts 201*a* and 201*b* may be continuously operated without such stop periods.

Also, application of charging bias has been performed up through periods T1 to T8 in the present embodiment, but this is not restrictive. Applying bias can be stopped within a range where toner fogging developing does not occur. For example, applying charging bias may be stopped during the periods T2, T4, T5, T6, and T8, where the photosensitive drum 1 and toner supply roller 220 are stopped, for example. Further, applying charging bias may be stopped at period T7 if the angle of rotation in period T7 is within an angle from the charging roller position on the photosensitive drum 1 to the developing roller 217. Further, application of charging bias may be performed from period T1 through partway into T3, and stop applying charging bias partway through period T3. The timing of quitting application of charging bias partway through period T3 may be as follows. That is to say, it is sufficient for the angle that the photosensitive drum 1 minimally rotates while applying charging bias in periods T1 through T3 is greater than the angle of rotation of the photosensitive drum 1 in the subsequent periods T3 through T8.

The form of the first coupling member 228*a* of the photosensitive drum 1 and the first drive shaft 201*a* are not restricted to being the same configuration as that in the first embodiment. Even in cases where other coupling forms are used, toner fogging of the photosensitive drum 1, drum rubbing memory, and scattering of toner can be suppressed by performing the preparatory operations of the present embodiment.

Although a configuration has been described in the present embodiment where drive force is transmitted to the developing roller 217 via the toner supply roller 220, this is not restrictive. A configuration may be made where the second coupling member 228*b* is fixed to the developing roller 217 or agitating member 23 or some other gear.

A configuration has been described in the present embodiment where the drum cartridge 213 and developing cartridge 204 are independently detachably mounted to the apparatus main body 200A. However, the present embodiment is not restricted to this arrangement, and application may be made to a cartridge configuration where one process cartridge 7 has the first coupling member 228*a* and second coupling member 228*b*, as in the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-025412 filed Feb. 14, 2017 and No. 2017-077613 filed Apr. 10, 2017, which are hereby incorporated by reference herein in their entirety.

What is claimed is:

1. An image forming apparatus, comprising:

an apparatus main body to which a cartridge can be detachably mounted;

a drive force transmission member configured to transmit drive force to a drive force receiving member of the cartridge; and a control unit configured to perform a rotation control operation, where rotation of the drive force transmission member is controlled, wherein image formation is performed on recording material by performing forward rotation of the drive force transmission member and transmitting drive force to the drive force receiving member of the cartridge, wherein the drive force transmission member includes a plurality of first engaging portions, wherein the drive force transmission member is configured to rotate forwards when the drive force receiving member rotates forward in a state where the plurality of first engaging portions each engage with a plurality of second engaging portions that the drive force receiving member has, and image formation on the recording material can be performed while the drive force receiving member is being rotated forwards, wherein, of the plurality of first engaging portions and the plurality of second engaging portions, one plurality of engaging portions each at least move in a radial direction centered on a rotation axis line of the drive force transmission member, and can move between an engageable position where the other plurality of engaging portions can be engaged, and a non-engageable position where the other plurality of engaging portions cannot be engaged, wherein, the control unit is configured to execute, after the cartridge has been mounted to the apparatus main body but before image formation is performed on the recording material, (i) a forward rotation step where the drive force transmission member is rotated forward by $\alpha°$ and the drive force receiving member is rotated forward, and (ii) a backward rotation step where the drive force transmission member is rotated backward by $\beta°$, after the forward rotation step, and wherein each of the plurality of first engaging portions is in a state disposed upstream in the forward rotation direction of the drive force transmission member from the second engaging portion out of the plurality of second engaging portions with which engaging will be realized in the end, due to the control unit having executed the forward rotation step and the backward rotation step.

2. The image forming apparatus according to claim 1, wherein $\alpha$ and $\beta$ satisfy the following Expressions (1) and (2)

$$\alpha \geq 360/N \quad (1)$$

$$\beta < 360/N \quad (2)$$

where N represents a count of the one plurality of engaging portions.

3. The image forming apparatus according to claim 2, wherein $\alpha°$ is an angle where at least one of the one plurality of engaging portions can engage at least one of the other plurality of engaging portions.

4. The image forming apparatus according to claim 1, wherein, when distinguishing an engaging portion of the one plurality of engaging portions that has not engaged any of the other plurality of engaging portions after forward rotation of the drive force transmission member by the $\alpha°$ as being a first unengaged engaging portion, and an engaging portion of the other plurality of engaging portions that has not engaged any of the one plurality of engaging portions after forward rotation of the drive force transmission member by the $\alpha°$ as a being second unengaged engaging portion, $\beta°$ is an angle where a second unengaged engaging portion at an upstream side in a backward rotation direction of the drive force transmission member from the first unengaged engaging portion can move to a downstream side of the first unengaged engaging portion.

5. The image forming apparatus according to claim 1, wherein $\beta$ satisfies the following Expression (3)

$$\beta < \theta 4 - \theta 5$$

where $\theta 4°$ represents a width of the other plurality of engaging portions in a circumferential direction centered on a rotation axis line of the drive force transmission member and $\theta 5°$ represents a width of the one plurality of engaging portions in the circumferential direction, and where $$\theta 4 > \theta 5$$

and $$(\theta 4 - \theta 5) < (360/N)$$

hold.

6. The image forming apparatus according to claim 1, wherein a rotation speed of forward rotation of the drive force transmission member by the $\alpha°$ is slower than a rotation speed of the drive force transmission member when performing image formation on the recording material.

7. The image forming apparatus according to claim 1, wherein a rotation speed of backward rotation of the drive force transmission member by the $\beta°$ is slower than a rotation speed of the drive force transmission member when performing image formation on the recording material.

8. The image forming apparatus according to claim 1, further comprising:

an opening/closing member configured to move between a closed position, where an opening through which the cartridge is mounted and detached is closed, and an open position where the opening is open; and a detector configured to detect whether or not the opening/closing member is at the closed position, wherein the control unit performs the rotation control operation, based on the detector having detected that the opening/closing member has transitioned from the open position to the closed position.

9. The image forming apparatus according to claim 1, wherein the control unit performs the rotation control operation, based on having detected that a state where electric power is not being provided to the apparatus main body has transitioned to a state where electric power is being provided to the apparatus main body.

10. The image forming apparatus according to claim 1, wherein the cartridge includes a photosensitive member, and wherein the drive force receiving member transmits drive force transmitted from the drive force transmission member to the photosensitive member.

11. The image forming apparatus according to claim 1, wherein the cartridge includes at least one of a developing agent bearing member, a developing agent supply member, and an agitating member, and wherein the drive force receiving member transmits drive force transmitted from the drive force transmission member to the at least one of developing agent bearing member, developing agent supply member, and agitating member.

12. An image forming apparatus, comprising:

an apparatus main body to which a cartridge can be detachably mounted;

first and second drive force transmission members configured to transmit drive force to first and second drive force receiving members of the cartridge; and a control unit configured to control rotation of the first and second drive force transmission members, wherein image formation is performed on recording material by performing forward rotation of the first and second drive force transmission members and transmitting drive force to the first and second drive force receiving members, wherein the first and second drive force transmission members each include a plurality of first engaging portions, wherein the first and second drive force receiving members rotate forwards when the first and second drive force transmission members rotate forward in a state where the plurality of first engaging portions each engage with a plurality of second engaging portions that the first and second drive force receiving members have, and image formation on the recording material can be performed while the first and second drive force receiving members are being rotated forwards, wherein, of the plurality of first engaging portions of the first drive force transmission member and the plurality of second engaging portions of the first drive force receiving member, one plurality of engaging portions each at least move in a radial direction centered on a rotation axis line of the drive force transmission member, and can move between an engageable position where the other plurality of engaging portions can be engaged, and a non-engageable position where the other plurality of engaging portions cannot be engaged, wherein, of the plurality of first engaging portions of the second drive force transmission member and the plurality of second engaging portions of the second drive force receiving member, one plurality of engaging portions each at least move in a radial direction centered on a rotation axis line of the drive force transmission member, and can move between an engageable position where the other plurality of engaging portions can be engaged, and a non-engageable position where the other plurality of engaging portions cannot be engaged, wherein, after the cartridge has been mounted to the apparatus main body but before image formation is performed on the recording material, the control unit executes (i) a first forward rotation step where the first drive force transmission member is rotated forward by $\alpha 1°$ and the first drive force receiving member is rotated forward, and (ii) a first backward rotation step where the first drive force transmission member is rotated backward by $\beta 1°$, after the first forward rotation step, and also executes (iii) a second forward rotation step where the second drive force transmission member is rotated forward by $\alpha 2°$ and the second drive force receiving member is rotated forward, and (iv) a second backward rotation step where the second drive force transmission member is rotated forward by $\beta 2°$, after the second forward rotation step, and wherein each of the plurality of first engaging portions of the first drive force transmission member is in a state disposed upstream in the forward rotation direction of the first drive force transmission members from the second engaging portion of the first drive force receiving member out of the plurality of second engaging portions with which engaging will be realized in the end at the first drive force transmission members, and each of the plurality of first engaging portions of the second drive force transmission member is in a state disposed upstream in the forward rotation direction of the second drive force transmission members from the second engaging portion of the second drive force receiving member out of the plurality of second engaging portions with which engaging will be realized in the end at the second drive force transmission members, due to the control unit having executed the first and second forward rotation steps and the first and second backward rotation steps.

13. The image forming apparatus according to claim 12, wherein $\alpha 1$, $\beta 1$, $\alpha 2$, and $\beta 2$ satisfy the following Expressions (1) through (4)

$$\alpha 1 \geq 360/N1 \quad (1)$$

$$\beta 1 < 360/N1 \quad (2)$$

$$\alpha 2 \geq 360/N2 \quad (3)$$

$$\beta 2 < 360/N2 \quad (4)$$

where N1 represents, of the plurality of first engaging portions of the first drive force transmission member and the plurality of second engaging portions of the first drive force receiving member, a count of the one plurality of engaging portions, and N2 represents, of the plurality of first engaging portions of the second drive force transmission member and the plurality of second engaging portions of the second drive force receiving member, a count of the one plurality of engaging portions.

14. The image forming apparatus according to claim 12, wherein the cartridge includes a photosensitive member, and a developing agent bearing member configured to bear developing agent to be adhered to the photosensitive member, and wherein rotation of the first drive force receiving member rotates the photosensitive member, and rotation of the second drive force receiving member rotates the developing agent bearing member.

15. The image forming apparatus according to claim 14, wherein the cartridge includes a first cartridge having the photosensitive member, and a second cartridge having the developing agent bearing member, and wherein the first cartridge and second cartridge are independently detachably mountable to the image forming apparatus.

16. The image forming apparatus according to claim 14, wherein the cartridge includes a charging member configured to charge the photosensitive member, wherein the control unit is configured to switch between a contact state where the photosensitive member and the developing agent bearing member are in contact, and a separated state where the photosensitive member and the developing agent bearing member are separated from each other, and wherein, in the separated state, the control unit performs forward rotation of the photosensitive member by γ° while charging the photosensitive member by the charging member, and thereafter in the contact state, executes the second forward rotation step.

17. The image forming apparatus according to claim 16, wherein the γ satisfies the following Expression (5)

$$\gamma^\circ \geq (360/N1+\theta 6^\circ) \quad (5)$$

wherein θ6° represents an angle at which a region of the photosensitive member charged by the charging member at least comes into contact with the developing agent bearing member.

18. The image forming apparatus according to claim 12, wherein the control unit performs forward rotation of the first drive force transmission member while executing the second forward rotation step, and performs backward rotation of the first drive force transmission member while executing the second backward rotation step.

* * * * *